US009281111B2

(12) United States Patent
Higuchi et al.

(10) Patent No.: US 9,281,111 B2
(45) Date of Patent: Mar. 8, 2016

(54) ELECTROMAGNETIC ACTUATOR

(71) Applicant: TOKYO WELD CO., LTD., Tokyo-to (JP)

(72) Inventors: Toshiro Higuchi, Tokyo-to (JP); Hiroyuki Nabae, Tokyo-to (JP); Koji Takahashi, Tokyo-to (JP)

(73) Assignees: TOKYO WELD Co., Ltd., Tokyo-To (JP); Toshiro Higuchi, Tokyo-To (JP); Hiroyuki Nabae, Tokyo-To (JP)

( * ) Notice: Subject to any disclaimer, the term of this patent is extended or adjusted under 35 U.S.C. 154(b) by 0 days.

(21) Appl. No.: 14/246,713

(22) Filed: Apr. 7, 2014

(65) Prior Publication Data

US 2014/0300435 A1 Oct. 9, 2014

(30) Foreign Application Priority Data

Apr. 8, 2013 (JP) ..... 2013-080731

(51) Int. Cl.
*H01F 7/08* (2006.01)
*H01F 7/16* (2006.01)
*G10K 9/13* (2006.01)

(52) U.S. Cl.
CPC ..... *H01F 7/1638* (2013.01); *G10K 9/13* (2013.01); *H01F 7/081* (2013.01)

(58) Field of Classification Search
CPC ..... H01F 7/066; H01H 53/015
USPC ..... 335/220
See application file for complete search history.

(56) References Cited

U.S. PATENT DOCUMENTS 3,295,808 A * 1/1967 Webb ..... 248/605
4,594,584 A 6/1986 Pfeiffer et al.
5,410,206 A 4/1995 Luecke et al.
5,682,132 A * 10/1997 Hiroyoshi et al. ..... 340/407.1
5,718,418 A * 2/1998 Gugsch ..... 267/140.14
6,169,342 B1 1/2001 Schmillen et al.
6,476,702 B1 * 11/2002 Hartwig et al. ..... 335/220

(Continued)

FOREIGN PATENT DOCUMENTS

DE 2 553 189 A1 4/1985
DE 297 13 167 U1 11/1998

(Continued)

OTHER PUBLICATIONS

Notification of Reason for Rejection issued in corresponding Korean Application No. 10-2014-0030330 on Feb. 17, 2015 (and English translation thereof).

(Continued)

*Primary Examiner* — Alexander Talpalatski
(74) *Attorney, Agent, or Firm* — Birch, Stewart, Kolasch & Birch, LLP

(57) ABSTRACT

There is provided an electromagnetic actuator which can secure a sufficient thrust force at least at a certain level over a wide range of displacement. The electromagnetic actuator 1 having a point of amplified displacement includes: a displacement amplification mechanism 1A made of a magnetic material and having two surfaces 2*as*, 2*bs* that form a gap 5 therebetween; and a coil 6 provided in the displacement amplification mechanism 1A. A magnetic flux is generated by passing an electric current through the coil 6, thereby generating an attraction force between the surfaces 2*as*, 2*bs*. The attraction force displaces the point of amplified displacement.

3 Claims, 14 Drawing Sheets

(56) References Cited

U.S. PATENT DOCUMENTS

| | | | | |
|---|---|---|---|---|
| 6,608,541 | B2 * | 8/2003 | Shiraki et al. | 335/222 |
| 6,777,895 | B2 * | 8/2004 | Shimoda et al. | 318/114 |
| 7,288,861 | B1 * | 10/2007 | Willard et al. | 310/15 |
| 7,525,403 | B2 * | 4/2009 | Kim | 335/222 |
| 7,550,880 | B1 * | 6/2009 | Pusl | 310/15 |
| 7,686,246 | B2 * | 3/2010 | Badre-Alam et al. | 244/17.13 |
| 8,129,870 | B1 * | 3/2012 | Pusl | 310/15 |
| 2001/0030306 | A1 | 10/2001 | Moler et al. | |
| 2002/0008602 | A1 * | 1/2002 | Kyouno et al. | 335/220 |
| 2005/0012405 | A1 | 1/2005 | Yajima et al. | |
| 2006/0044095 | A1 * | 3/2006 | Huang | 335/220 |

FOREIGN PATENT DOCUMENTS

| | | | |
|---|---|---|---|
| EP | 0 300 407 | A1 | 1/1989 |
| JP | 2000-217326 | A | 8/2000 |
| JP | 2004-048955 | A | 2/2004 |

OTHER PUBLICATIONS

Office Action issued in corresponding Taiwanese Patent Appliction No. 103111257 on Jul. 17, 2015 (with English translation).

* cited by examiner

ELECTROMAGNETIC ACTUATOR

CROSS-REFERENCE TO RELATED APPLICATION

This application claims the priority benefit of Japanese Patent Application No. 2013-80731, filed on Apr. 8, 2013, the disclosure of which is incorporated herein by reference in its entirety.

TECHNICAL FIELD

The present invention relates to an electromagnetic actuator including a displacement amplification mechanism, and more particularly to an electromagnetic actuator which can secure a sufficient thrust force at least at a certain level over a wide range of displacement and which can reduce the overall size of the device.

BACKGROUND ART

Electromagnetic actuators using an electromagnetic attraction force are known in the prior art. FIGS. 20(*a*) through 20(*c*) show a prior-art electromagnetic attraction force generation mechanism constituting an electromagnetic actuator. FIG. 20(*a*) is a front view of the electromagnetic attraction force generation mechanism 101. The electromagnetic attraction force generation mechanism 101 is comprised of a magnetic body, such as iron, having a generally-rectangular cross-section. In particular, the electromagnetic attraction force generation mechanism 101 includes a pair of attracting iron cores 102*a*, 102*b*, extending in approximately the same direction, and a magnetic force generating iron core 103 connecting the ends of the attracting iron cores 102*a*, 102*b*, and thus has the shape of the letter "U".

Wiring 104, composed of a linear conductive material such as a copper wire, is wound around the magnetic force generating iron core 103. The other ends of the attracting iron cores 102*a*, 102*b* are flat attracting surfaces 102*as*, 102*bs*. FIG. 20(*b*) shows the electromagnetic attraction force generation mechanism 101 of FIG. 20(*a*) as viewed in the direction of arrow A101, and FIG. 20(*c*) shows the electromagnetic attraction force generation mechanism 101 of FIG. 20(*a*) as viewed in the direction of arrow B101. The wiring 104 is omitted in FIGS. 20(*b*) and 20(*c*). As shown in FIGS. 20(*b*) and 20(*c*), the cross-sectional area of each of the attracting iron cores 102*a*, 102*b* is approximately the same as the cross-sectional area of the magnetic force generating iron core 103.

FIG. 21 shows an electromagnetic actuator 111 using the electromagnetic attraction force generation mechanism 101. In the electromagnetic actuator 111, the attracting surfaces 102*as*, 102*bs* of the electromagnetic attraction force generation mechanism 101 are held approximately vertical by means of a not-shown holding mechanism. A movable iron piece 106 is disposed in a position opposite the attracting surfaces 102*as*, 102*bs* of the electromagnetic attraction force generation mechanism 101 with a slight gap 105 between them, as shown by the solid lines. The length of the gap 105 between one surface 106*s*1 of the movable iron piece 106 in that position and the attracting surfaces 102*as*, 102*bs* is x101.

The opposite surface 106*s*2 of the movable iron piece 106 is connected via a wire 107*a* to one end of a spring 108, and the other end of the spring 108 is connected via a wire 107*b* to a wall surface 109. The surfaces 106*s*1, 106*s*2 of the movable iron piece 106 are approximately vertical; the attracting surfaces 102*as*, 102*bs* of the electromagnetic attraction force generation mechanism 101 are approximately parallel to the opposing surface 106*s*1 of the movable iron piece 106.

The operation of the electromagnetic actuator 111 will now be described with reference to FIG. 21. When a voltage is applied to the wiring 104, an electric current is supplied to the siring 104 and a magnetic flux is generated and increased in the flowing magnetic circuit: magnetic force generating iron core 103→attracting iron core 102*a*→gap 105→movable iron piece 106→gap 105→attracting iron core 102*b*→magnetic force generating iron core 103. Accordingly, an attraction force is generated and is applied from the attracting surfaces 102*as*, 102*bs* to the surface 106*s*1 of the movable iron piece 106 via the gap 105. Therefore, the spring 108 extends and the movable iron piece 106 is displaced toward the attracting surfaces 102*as*, 102*bs*, and the surface 106*s*1 is attracted and attached to the attracting surfaces 102*as*, 102*bs*, as shown by the broken lines in FIG. 21. Thus, the length of the gap 105 becomes substantially zero.

The movable iron piece 106 moves while maintaining the approximately vertical position by means of a guide or a parallel spring as a guide, both not shown. The surface 106*s*1 of the movable iron piece 106 can therefore be kept parallel to the attracting surfaces 102*as*, 102*bs* of the electromagnetic attraction force generation mechanism 101 during the movement of the movable iron piece 106.

When the voltage applied to the wiring 104 is shut off, the electric current disappears, whereby the magnetic flux in the magnetic circuit decreases. Due to the biasing force of the spring 108, the surface 106*s*1 of the movable iron piece 106 moves away from the attracting surfaces 102*as*, 102*bs* and returns to the position shown by the solid lines in FIG. 21, i.e. the position where the length of the gap 105 between the surface 106*s*1 and the attracting surfaces 102*as*, 102*bs* is x101. Thus, the displacement produced in the movable iron piece 106 by means of the electromagnetic attraction force generation mechanism 101 is x101.

Such electromagnetic actuator 111 has the following problems: FIG. 22 is a graph showing the relationship between displacement and thrust force in the electromagnetic actuator 111, as observed when a constant electric current is supplied to the wiring 104. In FIG. 22, the abscissa represents the displacement x101, and the ordinate represents the attraction force, i.e. the thrust force, applied from the electromagnetic attraction force generation mechanism 101 to the movable iron piece 106 when the displacement is produced. As can be seen in FIG. 22, though the thrust force is sufficiently high when the displacement is small, the thrust force drastically decreases as the displacement increases.

Thus, the attraction force, i.e. the thrust force, applied from the electromagnetic attraction force generation mechanism 101 to the movable iron piece 106 is significantly low when the length of the gap 105 (displacement) x101, shown in FIG. 21, is large as compared to the case where the displacement x101 is small; the thrust force applied to the movable iron piece 106 is very low when the movable iron piece 106 lies in a position farthest from the attracting surfaces 102*as*, 102*bs* of the electromagnetic attraction force generation mechanism 101.

When it is intended to produce some effect, e.g. the generation of vibration, by using the thrust force, only a very low vibration force can be obtained when the thrust force is very low. Thus, in order to obtain a sufficiently high thrust force in the prior-art electromagnetic actuator 111, the displacement must be limited to a very small value range. To obtain a sufficiently high thrust force with the use of a large displacement, it is necessary to supply a high electric current to the wiring 104 of the electromagnetic attraction force generation mechanism 101. This requires the use an electronic part(s), which is adapted for high electric current, in a current supply circuit for the wiring 104, leading to an increase in the cost or size of the circuit. In addition, because of non-integration of the electromagnetic actuator 111 as a whole, parts such as the electromagnetic attraction force generation mechanism 101, the movable iron piece 106, the wires 107*a*, 107*b* and the spring 108 are produced separately and thereafter assembled. This requires a complicated process for the production of the electromagnetic actuator 111.

SUMMARY OF THE INVENTION

The present invention has been made in view of the above situation. It is therefore an object of the present invention to provide an electromagnetic actuator which makes it possible to reduce a drastic decrease in the thrust force with increase in the displacement, to reduce the range of change in the thrust force even when the displacement changes over a wide range, and to reduce the overall size of the actuator, thereby enabling easier production of the actuator.

In order to achieve the object, the present invention provides an electromagnetic actuator having a point of amplified displacement, comprising: a displacement amplification mechanism including a magnetic body having a thrust generating portion; and a coil, provided in the displacement amplification mechanism, for generating a magnetic flux in the magnetic body, wherein a magnetic flux is generated in the magnetic body by passing an electric current through the coil, thereby generating a thrust force in the thrust generating portion, and the point of amplified displacement is displaced by the thrust force.

In a preferred embodiment of the present invention, the thrust generating portion consists of two surfaces that form a gap therebetween.

In a preferred embodiment of the present invention, the displacement amplification mechanism has an annular portion and at least one pair of displacement portions disposed inside the annular portion and forming a gap therebetween.

At least part of the annular portion may be comprised of an elastic member.

The coil may be provided in one of the pair of displacement portions.

In a preferred embodiment of the present invention, two or more pairs of displacement portions, forming a gap therebetween, are provided inside the annular portion.

The electromagnetic actuator of the present invention makes it possible to reduce a drastic decrease in the thrust force with increase in the displacement, to reduce the range of change in the thrust force over a wide range of displacement, and to reduce the overall size of the device.

DETAILED DESCRIPTION OF THE PREFERRED EMBODIMENTS

First Embodiment

Preferred embodiments of the present invention will now be described in detail with reference to the drawings.

FIGS. 1 through 10 are diagrams illustrating an electromagnetic actuator according to a first embodiment of the present invention.

At the outset, the basic principle of the present invention will be described with reference to a model of a magnetic circuit and its displacement-thrust force characteristics.

Figure 1:
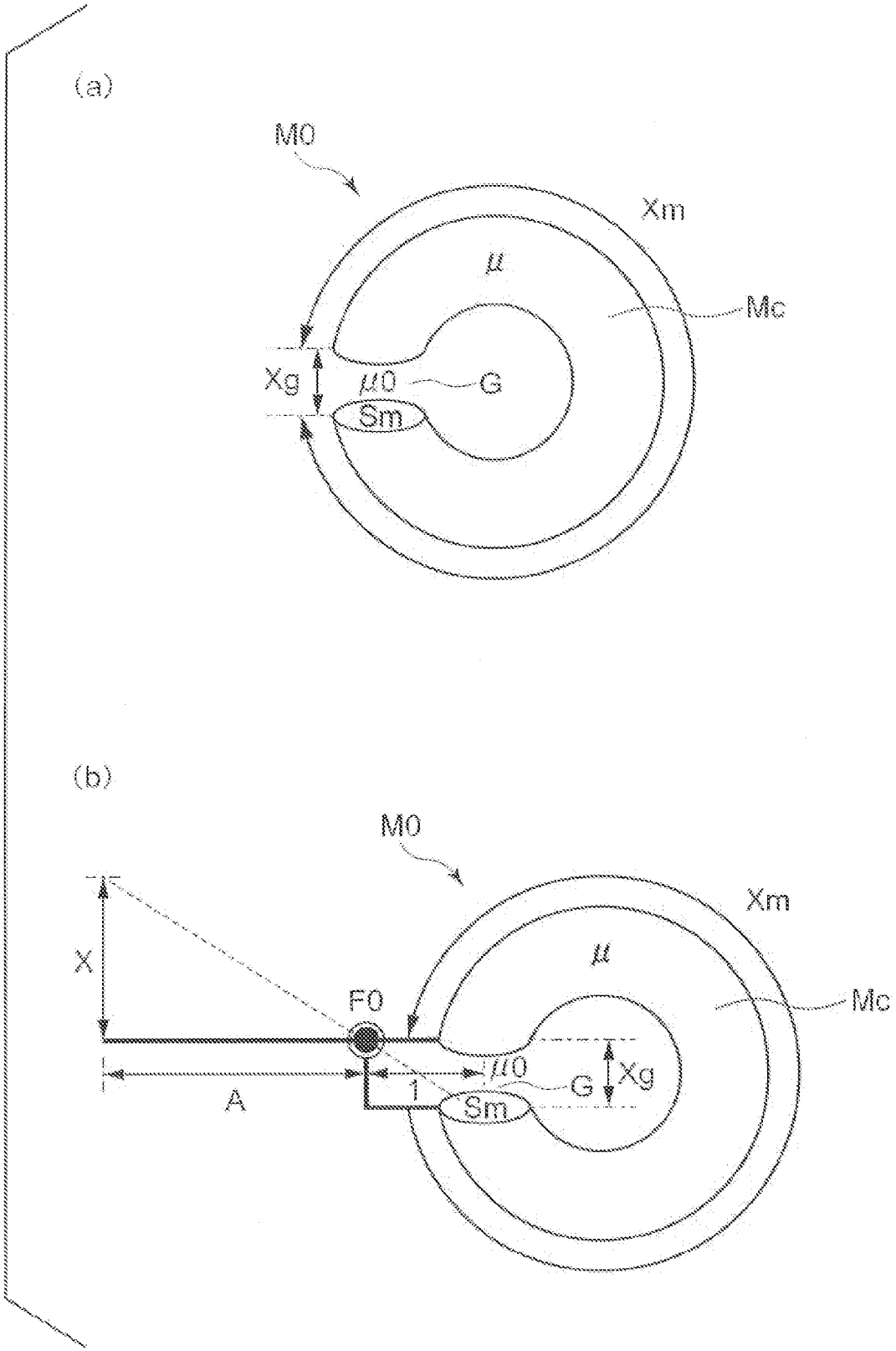
FIGS. 1(*a*) and 1(*b*) are diagrams showing a model of a magnetic circuit.

FIGS. 1(*a*) and 1(*b*) are diagrams showing a model of a magnetic circuit; FIG. 1(*a*) shows the magnetic circuit model, and FIG. 1(*b*) shows a model in which a displacement amplification mechanism is added to the magnetic circuit. The illustrated magnetic body Mc has the shape of an open ring having a length Xm and a cross-sectional area Sm, and having a gap G with a length Xg.

Figure 2:
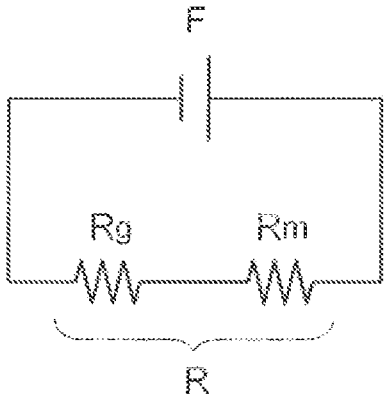
FIG. 2 is a diagram showing an electrical circuit substituted for the magnetic circuit of FIG. 1.

Though not shown diagrammatically, wiring of conductive material is wound around the magnetic body Mc. When a voltage V is applied to both ends of the wiring, an electric current I is supplied to the wiring, whereby the magnetic body Mc becomes magnetized. The magnetic body Mc and the gap G form a magnetic circuit M0. FIG. 2 shows an electrical circuit substituted for the magnetic circuit M0 of FIG. 1(*a*). In the electrical circuit, the reluctance Rm of the magnetic body Mc and the reluctance Rg of the gap G are connected in series, with a magnetic potential difference F being applied to the circuit.

The combined reluctance R of the series-connected reluctances Rm and Rg can be determined by the following equation:

$$R=Rm+Rg=Xm/Sm\mu+Xg/Sm\mu0 \quad (1)$$

where μ is the magnetic permeability of the magnetic body Mc, and μ0 is the magnetic permeability of the gap G (the magnetic permeability of air).

The magnetic flux ϕ can be determined by dividing the magnetic potential difference F by the reluctance R:

$$\phi=F/R=F/(Rm+Rg)=NISm/(Xm/\mu+Xg/\mu 0) \quad (2)$$

where N is the number of turns of the wiring, and I is the electric current.

The following relation is used in the above calculation (2):

$$F=NI \quad (3)$$

Next, the attraction force, i.e. the thrust force Fg, acting between the opposing surfaces on both sides of the gap G by the action of the magnetic circuit M0 in FIG. 1, is determined. The wiring wound around the magnetic body Mc acts as an inductor. The magnetic energy Um stored in the wiring (inductor), i.e. the work performed by a power source, is determined. The voltage V of the power source, the electric current I flowing in the wiring and the inductance L of the wiring satisfy the following equation:

$$\begin{aligned} Um &= \int_0^1 IV\,dt \\ &= \int_0^1 IL\frac{dI}{dt}\cdot dt \quad \left(\because V = L\frac{dI}{dt}\right) \\ &= \int_0^1 LI\,dI \\ &= LI^2/2 \end{aligned} \quad (4)$$

V=Ndϕ/dt, i.e., LdI/dt=Ndϕ/dt therefore LI=Nϕ

The equation (4) can therefore be transformed to:

$$Um=Nd\phi/2 \quad (5)$$

The magnetic potential difference F and the reluctance R satisfy the following relation:

$$F=NI=\phi R \quad (6)$$

Therefore, using the equation (6), the equation (5) can be transformed to:

$$\begin{aligned} Um &= \Phi F/2 \\ &= \Phi^2 R/2 \end{aligned} \quad (7)$$

A change in the magnetic energy corresponds to a mechanical work performed to or from the outside.

Consider now a work in an X direction which coincides with the direction of the length Xg of the gap G, shown in FIG. 1.

The mechanical energy Ud can be expressed as follows:

$$Ud=\int_0^\infty Fxdx$$

The force produced by a change in the energy can therefore be expressed as follows:

$$Fx=dUd/dx \quad (8)$$

Since a change in Ud corresponds to a change in Um, the equation (8) can be transformed to:

$$\begin{aligned} Fx &= \frac{dUm}{dx} \\ &= \frac{d}{dx}\cdot\Phi^2 R/2 \quad (\because \text{equation (7)}) \\ &= \Phi^2/2\cdot\frac{dR}{dx} \\ &= \Phi^2/2\cdot\frac{d}{dx}\cdot(Xm/Sm\mu + Xg/Sm\mu 0)(\because \text{equation (1)}) \\ &= \Phi^2/2\mu 0Sm \end{aligned} \quad (9)$$

The force thus determined is the attraction force, i.e. the thrust force, acting between the opposing surfaces on both sides of the gap G. The equation (9) can be transformed by applying the equation (6) and the equation (1) to the equation (9) as follows:

$$\begin{aligned} Fx &= \Phi^2/2\mu 0Sm \\ &= N^2I^2/2\mu 0SmR^2 \\ &= N^2I^2Sm\mu 0/2(\mu 0/\mu\cdot Xm + Xg)^2 \\ &= aI^2/(\overline{X} + Xg)^2 \end{aligned} \quad (10)$$

where $\alpha=N^2Sm\mu 0/2$ $\overline{X}=\mu 0/\mu\cdot Xm$

The equation (10) shows the relationship between the length of the gap G, i.e. the displacement Xg, and the thrust force Fx; the thrust force Fx is inversely proportional to the square of the displacement Xg. Consider now adding a displacement amplification mechanism, which utilizes the principle of leverage and is an essential feature of the present invention, to the magnetic circuit of FIG. 1. Thus, as shown in FIG. 1(*b*), the displacement Xg is amplified by A times into X with a point F0 as a fulcrum. Accordingly, A-times displacement amplification (displacement amplification ratio is A) is made to the equation (10) that shows the relationship between the displacement Xg and the thrust force Fx. By the amplification of the displacement, the displacement Xg in the equation (10) is replaced by the A-times amplified displacement (the displacement X shown in FIG. 1(*b*)), and the thrust force Fx in the equation (10) is replaced by a thrust force which is reduced to 1/A of the thrust force at the length Xg of the gap G before the displacement amplification. Taking into consideration the amplification of the displacement and the reduction of the thrust force made by the displacement amplification mechanism, the equation (10) can be rewritten to define the thrust force FA after the displacement amplification in the following manner: The A-times amplified displacement X is to be regarded as the displacement Xg in the equation (10). Accordingly, in order to convert the displacement Xg into the value before the displacement amplification, the displacement Xg is made 1/A in the equation (10) and, in addition, the thrust force Fx at the displacement before the displacement amplification is made 1/A. Thus, the thrust force FA after the displacement amplification can be expressed by the following equation:

$$\begin{aligned} FA &= aI^2/A(\overline{X} + Xg/A)^2 \\ &= AaI^2/(A\overline{X} + Xg)^2 \end{aligned} \quad (11)$$

Comparison will now be made between the thrust force Fx and the thrust force FA in terms of the relationship with the displacement Xg at a constant electric current I.

Figure 3:
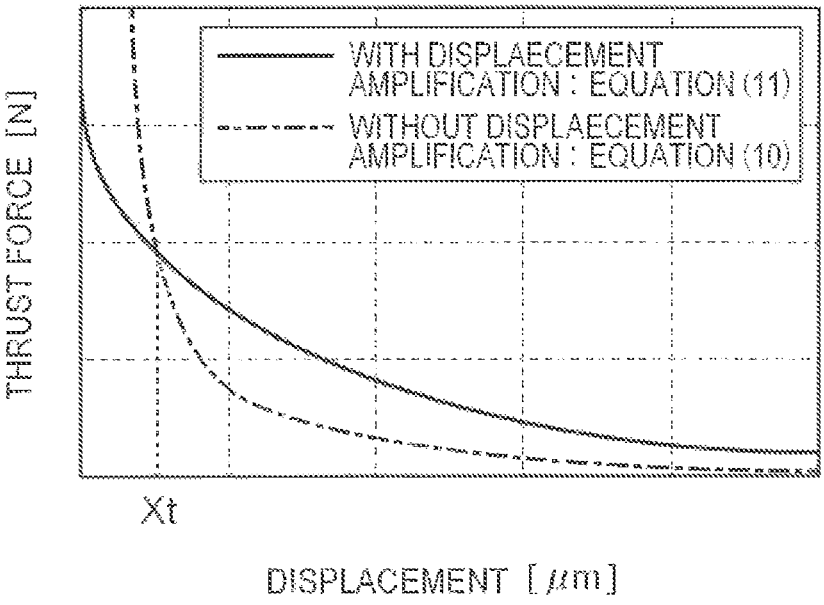
FIG. 3 is a graph showing the relationship between displacement and thrust force in the magnetic circuit of FIG. 1.

As described above, the equation (10) expresses the relationship between the displacement Xg and the thrust force Fx when no displacement amplification is made, while the equation (11) expresses the relationship between the displacement Xg and the thrust force FA when the displacement amplification is made. FIG. 3 shows the equations (10) and (11) in graph form, with the abscissa representing the displacement and the ordinate representing the thrust force.

In FIG. 3, the dashed-dotted line represents the equation (10) and the solid line represents the equation (11). The thrust force with the displacement amplification is larger than the thrust force without the displacement amplification when the displacement is higher than a certain value Xt. Conversely, the thrust force with the displacement amplification is smaller than the thrust force without the displacement amplification when the displacement is lower than the value Xt.

Figure 22:
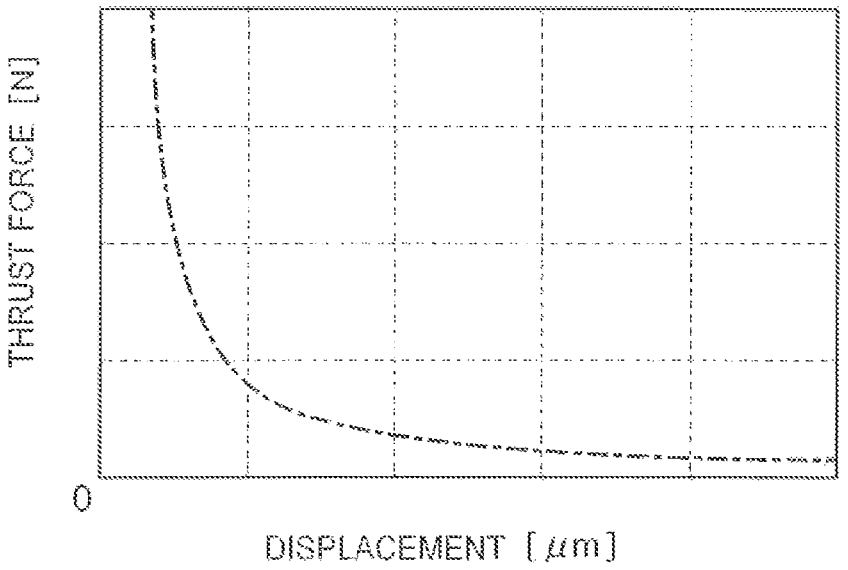
FIG. 22 is a graph showing the relationship between displacement and thrust force in the prior-art electromagnetic actuator.

The dashed-dotted line graph of FIG. 3 is similar to the graph of FIG. 22 which shows the relationship between displacement and thrust force in the electromagnetic actuator 111 in which no displacement amplification is made.

As can be seen in FIG. 3, the thrust force at the same displacement becomes larger in the range of displacement higher than Xt by making the displacement amplification, whereas the thrust force at the same displacement becomes smaller in the range of displacement lower than Xt by making the displacement amplification. This means that by making the displacement amplification, a drastic decrease in the thrust force in a displacement range higher than Xt is reduced and the range of change in the thrust force is reduced over a wide range of distribution. It therefore becomes possible to secure a sufficient thrust force at least at a certain level over a wide displacement range which is intended to be used.

It is noted in this regard that as described above, in the relationship between the length of the gap G, i.e. the displacement Xg, and the thrust force Fx, the thrust force Fx is inversely proportional to the square of the displacement Xg. Thus, if no displacement amplification is made to the electromagnetic actuator, the thrust force Fx greatly increases with decrease in the displacement Xg and greatly decreases with increase in the displacement Xg.

In this embodiment the displacement Xg is increased by A times and the thrust force Fx is decreased to 1/A by making the A-times displacement amplification to the magnetic actuator, whereby the graph showing the relationship between the displacement Xg and the thrust force Fx becomes flatter as shown in FIG. 3.

The above description of the relationship between the displacement and the thrust force is based on the assumption of the same electric current. In electromagnetism, thrust force increases in a simple manner with increase in electric current supplied. Thus, to reduce a decrease in the thrust force in a displacement range higher than Xt, i.e. to obtain a larger thrust force at the same electric current, means that the same thrust force can be obtained at a lower electric current when the displacement is larger than Xt.

This also means that when it is intended to obtain a sufficient thrust force in a displacement range which is higher than a certain displacement, it is not necessary to use an electronic part(s), which is adapted for high electric current, in a current supply circuit, making it possible to avoid an increase in the cost or size of the circuit.

The first embodiment of the present invention, which adds a displacement amplification mechanism to a magnetic circuit as shown in FIG. 1 based on the above-described principle, i.e. an electromagnetic actuator according to the present invention which comprises the combination of the magnetic circuit and the displacement amplification mechanism, will now be described with reference to FIGS. 4(*a*) through 4(*c*) and FIG. 5.

Figure 4:
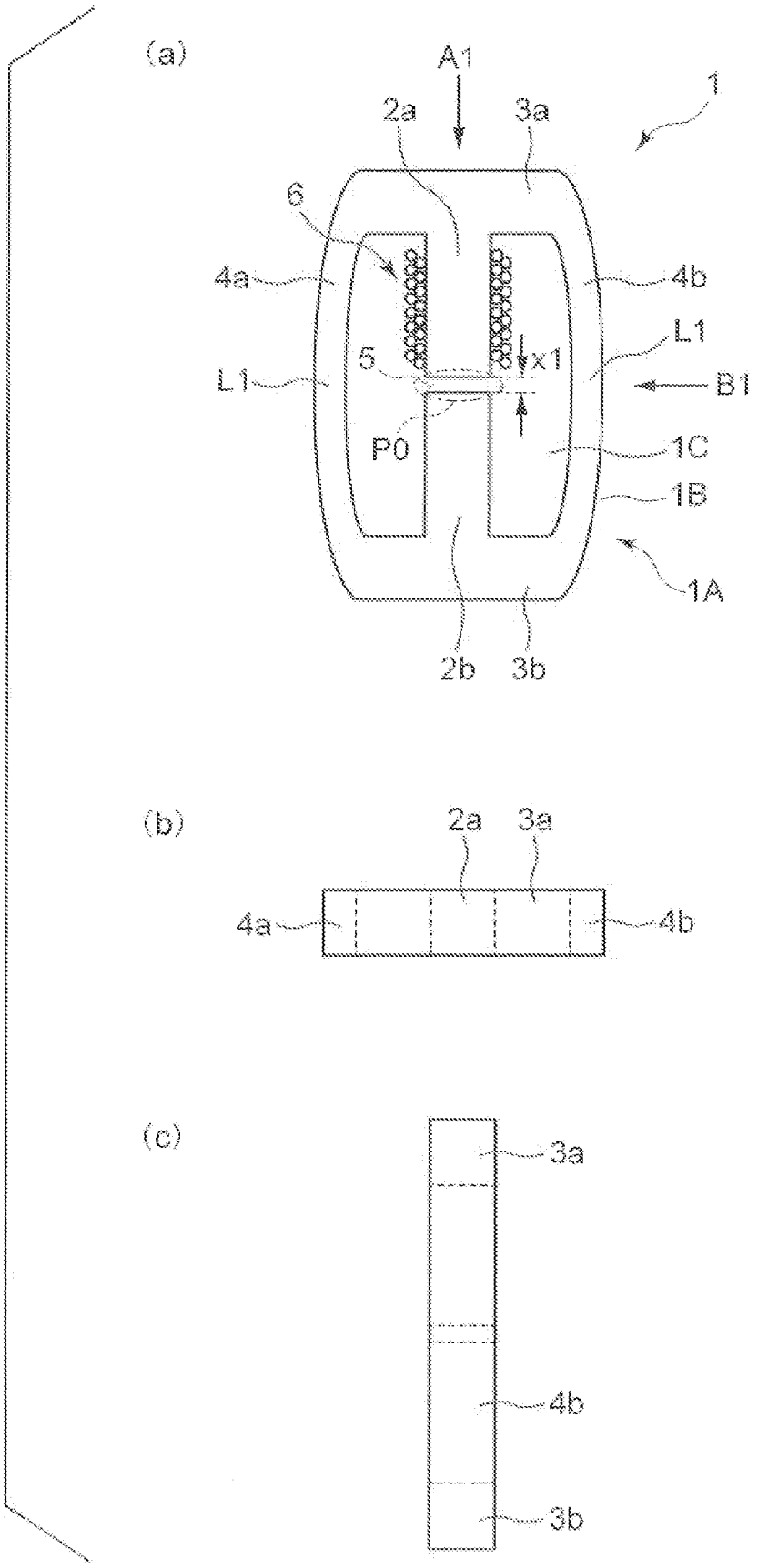
FIGS. 4(*a*) through 4(*c*) are diagrams showing an electromagnetic actuator according to a first embodiment of the present invention.

FIG. 4(*a*) is a front view of an electromagnetic actuator, FIG. 4(*b*) shows the electromagnetic actuator of FIG. 4(*a*) as viewed in the direction of arrow A1, and FIG. 4(*c*) shows the electromagnetic actuator of FIG. 4(*a*) as viewed in the direction of arrow B1. FIG. 5 is an enlarged view of the area P0 of FIG. 4(*a*).

As shown in FIGS. 4(*a*) through 4(*c*) and FIG. 5, the electromagnetic actuator 1 has a point L1 of displacement (point of load) as will be described later. The electromagnetic actuator 1 includes a displacement amplification mechanism 1A made of a magnetic material, having a quadrangular cross-section and having two opposing surfaces 2*as*, 2*bs* which form a gap 5 between them, and a coil (wiring) 6 provided in the displacement amplification mechanism 1A and which generates a magnetic flux in the displacement amplification mechanism 1A. By passing an electric current through the coil 6, a magnetic flux is generated in the displacement amplification mechanism 1A to cause a change in the length x1 of the gap (thrust portion) 5 between the surfaces 2*as*, 2*bs*, thereby displacing the point L1 of displacement.

Though the illustrated displacement amplification mechanism 1A has a quadrangular cross-section, it is possible to use a displacement amplification mechanism 1A having a circular cross-section or a cross-section of another polygonal shape, such as a pentagonal or hexagonal cross-section.

The displacement amplification mechanism 1A will now be described. The displacement amplification mechanism 1A includes a pair of support iron cores 3*a*, 3*b* comprised of elastic members, a pair of movable iron cores 4*a*, 4*b* comprised of elastic members and located on both sides of the pair of support iron cores 3*a*, 3*b*, and a pair of attracting iron cores 2*a*, 2*b* extending inwardly from the support iron cores 3*a*, 3*b* and having the two opposing surfaces 2*as*, 2*bs* which form the gap 5. The support iron cores 3*a*, 3*b* and the movable iron cores 4*a*, 4*b* constitute an annular portion 1B, and the attracting iron cores 2*a*, 2*b* constitute a pair of displacement portions 1C.

The constituent members of the displacement amplification mechanism 1A will now be described in further detail. A middle portion of the support iron core 3*a* is connected to one end of the attracting iron core 2*a*; the support iron core 3*a* and the attracting iron core 2*a* form a T-shaped portion. Similarly, a middle portion of the support iron core 3*b*, having the same shape as the support iron core 3*a*, is connected to one end of the attracting iron core 2*b* having the same shape as the attracting iron core 2*a*; the support iron core 3*b* and the attracting iron core 2*b* form a T-shaped portion. The surface of the other end of the attracting iron core 2*a* faces the surface of the other end of the attracting iron core 2*b*. The movable iron cores 4*a*, 4*b* are connected to the opposite ends of the support iron cores 3*a* and 3*b*.

The movable iron cores 4*a*, 4*b* are slightly convex curved outward, i.e. in a direction away from the attracting iron cores 2*a*, 2*b*.

As described above, the support iron cores 3*a*, 3*b* and the movable iron cores 4*a*, 4*b* constitute the annular portion 1B. Further, as described above, the two opposing surfaces 2*as*, 2*bs* of the attracting iron cores 2*a*, 2*b* form the slight gap 5 with the length x1. The wiring 6, composed of a linear conductive material such as a copper wire, is wound around the attracting iron core 2*a*.

The wiring 6 is omitted in FIGS. 4(*b*) and 4(*c*). As shown in FIGS. 4(*b*) and 4(*c*), the cross-sectional area of each of the attracting iron cores 2*a*, 2*b* is approximately the same as the cross-sectional area of each of the support iron cores 3*a*, 3*b*. The cross-sectional area of each of the movable iron cores 4*a*, 4*b* is approximately ½ of the cross-sectional area of each of the attracting iron cores 2*a*, 2*b*. As shown in FIG. 5 which is an enlarged view of the area P0 of FIG. 4(*a*), the gap 5 is formed between the opposing surfaces 2*as*, 2*bs*, lying at positions 2*a*1, 2*b*1, of the attracting iron cores 2*a*, 2*b*, with the distance between the positions 2*a*1, 2*b*1 being x1.

The operation of the electromagnetic actuator of this embodiment, having the above-described construction, will now be described with reference to FIGS. 6 and 7.

Figure 6:
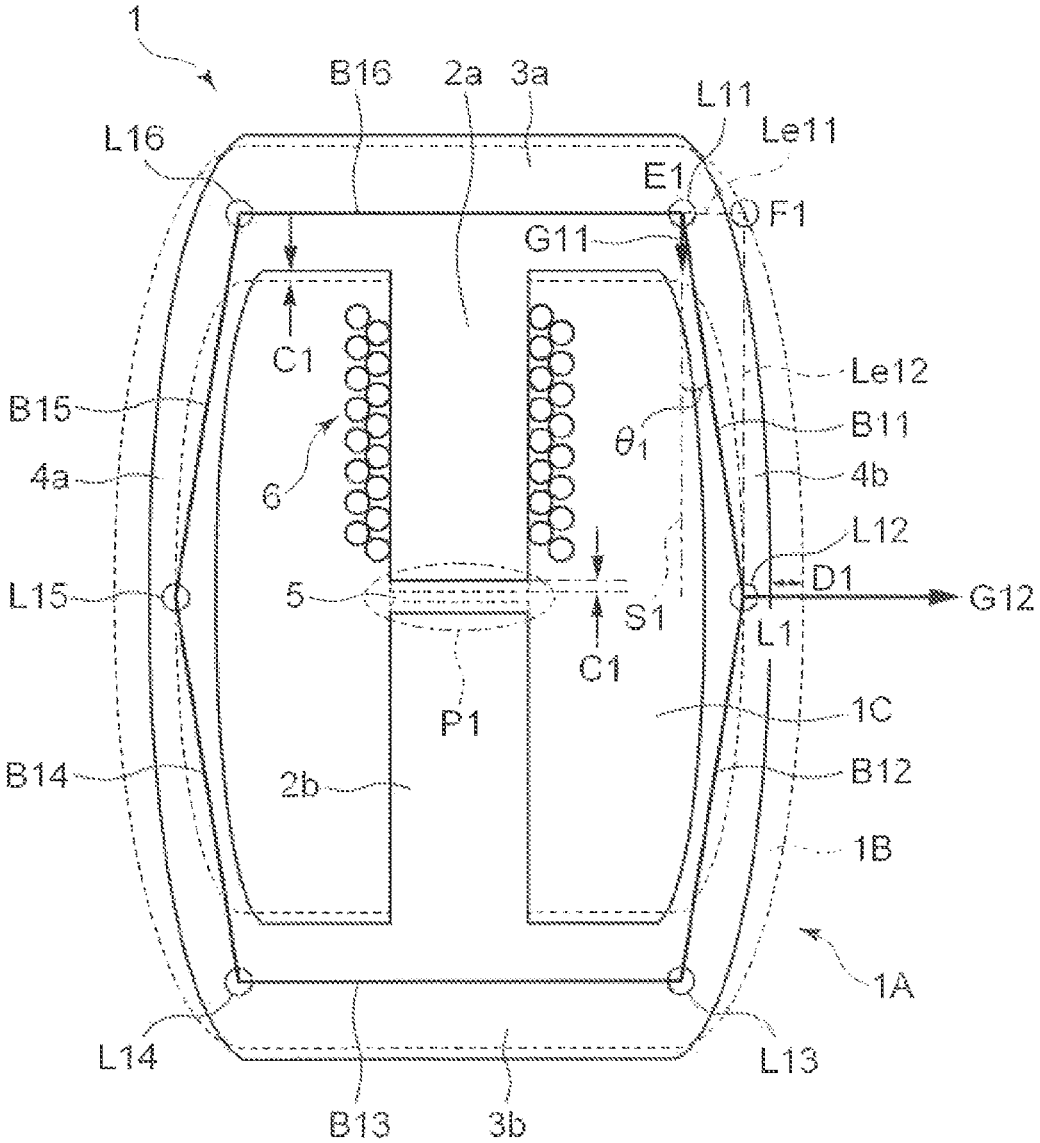
FIG. 6 is an enlarged view of the electromagnetic actuator of FIG. 4(*a*)

FIG. 6 is an enlarged view of the electromagnetic actuator of FIG. 4(*a*). An electric current is supplied to the coil (wiring) 6 when a voltage is applied to it by connecting a not-shown power source to both ends of the coil (wiring) 6. Upon the supply of electric current, a first magnetic circuit is formed through which a magnetic flux passes as follows: attracting iron core 2*a*→support iron core 3*a*→movable iron core 4*a*→support iron core 3*b*→attracting iron core 2*b*→gap 5→attracting iron core 2*a*. In addition, a second magnetic circuit is formed through which a magnetic flux passes as follows: attracting iron core 2*a*→support iron core 3*a*→movable iron core 4*b*→support iron core 3*b*→attracting iron core 2*b*→gap 5→attracting iron core 2*a*. The magnetic flux in the first and second magnetic circuits increases by the supply of electric current.

The displacement amplification mechanism 1A thus forms the magnetic circuits including the support iron cores 3*a*, 3*b* and the movable iron cores 4*a*, 4*b* and through which a magnetic flux passes. The magnetic circuits include the gap 5 formed between the surfaces 2*as*, 2*bs* of the attracting iron cores 2*a*, 2*b* of magnetic material as shown in FIG. 5. Therefore, an attraction force (thrust force) is generated between the surfaces 2*as*, 2*bs* through the gap (thrust portion) 5. Because the support iron cores 3*a*, 3*b* and the movable iron cores 4*a*, 4*b* are comprised of elastic members, the attraction force generated between the opposing surfaces 2*as*, 2*bs* of the attracting iron cores 2*a*, 2*b* causes the surfaces 2*as*, 2*bs* to move closer to each other. The movement is illustrated in FIG. 7 which is an enlarged view of the area P1 of FIG. 6.

Figure 5:
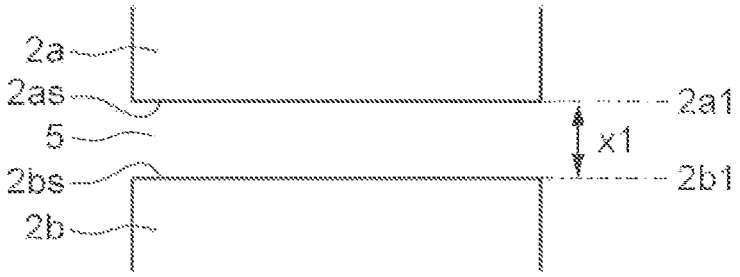
FIG. 5 is an enlarged view of the area P0 of FIG. 4(*a*)
Figure 7:
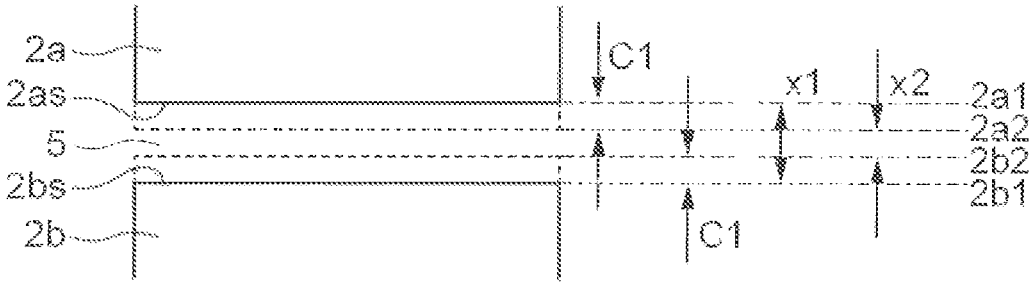
FIG. 7 is an enlarged view of the area P1 of FIG. 6.

When no electric current is flowing in the wiring 6 in FIG. 6, the positions of the opposing surfaces 2*as*, 2*bs* of the attracting iron cores 2*a*, 2*b* are 2*a*1 and 2*b*1, respectively, in FIG. 7 and the distance between them is x1 as in FIG. 5. This is illustrated by the solid lines in FIG. 7.

As described above, when an electric current flows in the wiring 6 in FIG. 6, an attraction force acts between the opposing surfaces 2*as*, 2*bs* of the attracting iron cores 2*a*, 2*b*, whereby the position of the surface 2*as* and the position of the surface 2*bs* come closer to 2*a*2 and 2*b*2, respectively, and the gap 5 becomes narrower; the distance between the surfaces 2*as*, 2*bs* becomes x2 as shown by the broken lines in FIG. 7. Thus, by supplying the electric current to the wiring 6, a displacement C1 is produced in each of the surfaces 2*as*, 2*bs* as shown in FIG. 7.

When the application of voltage to the wiring 6 is shut off, the magnetic flux in the above-described magnetic circuits decreases and the attraction force, acting between the surfaces 2*as*, 2*bs*, disappears. Because the support iron cores 3*a*, 3*b* and the movable iron cores 4*a*, 4*b* are comprised of elastic members, the opposing surfaces 2*as*, 2*bs* of the attracting iron cores 2*a*, 2*b* return to the positions 2*a*1, 2*b*1, respectively.

Thus, the gap 5 returns to the state as observed when there is no electric current flowing in the wiring 6, i.e. when there is no generation of magnetic flux; the distance between the surfaces 2*as*, 2*bs* becomes x1.

As described above, a displacement C1 is produced in each of the opposing surfaces 2*as*, 2*bs* of the attracting iron cores 2*a*, 2*b* in the electromagnetic actuator 1.

The displacement C1, produced in each of the opposing surfaces 2*as*, 2*bs* of the attracting iron cores 2*a*, 2*b*, is illustrated also in the area P1 of FIG. 6.

In this embodiment the attracting iron cores 2*a*, 2*b* thus return to the original positions via the support iron cores 3*a*, 3*b* and the movable iron cores 4*a*, 4*b*, constituting the displacement amplification mechanism 1A. Therefore, there is no need to separately provide an elastic body in order to return the attracting iron cores 2*a*, 2*b* to the original positions, making it possible to reduce the overall size and the cost of the displacement amplification mechanism 1A.

The mechanism of amplification of the displacement C1 will now be described with reference to FIG. 6.

The displacement C1 in each of the opposing surfaces 2*as*, 2*bs* of the attracting iron cores 2*a*, 2*b* in the area P1, shown by the broken lines in FIG. 6, is produced at the opposing ends of the attracting iron cores 2*a*, 2*b*. Therefore, the same displacement C1 in the same direction is produced also in the support iron cores 3*a*, 3*b* whose middle portions are connected to the other ends of the attracting iron cores 2*a*, 2*b*. This is illustrated in FIG. 6 in the portion of the support iron core 3*a* by the broken lines and the symbol C1, indicating the same displacement as in the attracting iron core 2*a*. The displacement C1 of the support iron core 3*a* is amplified by the support iron core 3*a* and by the movable iron cores 4*a*, 4*b* connected to both ends of the support iron core 3*a*. The support iron core 3*a* and the support iron core 3*b* are disposed vertically symmetrically. Thus, the support iron cores 3*a*, 3*b* and the movable iron cores 4*a*, 4*b* as a whole constitute a link mechanism for displacement amplification.

The principle will now be described with reference to a link mechanism as applied to the support iron cores 3*a*, 3*b* and the movable iron cores 4*a*, 4*b*, constituting the displacement amplification mechanism 1A in FIG. 6. The link mechanism has six link connection points: a connection point L11 between the support iron core 3*a* and the movable iron core 4*b*; a midpoint L12 of the movable iron core 4*b*; a connection point L13 between the movable iron core 4*b* and the support iron core 3*b*; a connection point L14 between the support iron core 3*b* and the movable iron core 4*a*; a midpoint L15 of the movable iron core 4*a*; and a connection point L16 between the movable iron core 4*a* and the support iron core 3*a*. The link connection points L11, L12, L13, L14, L15 and L16 are disposed clockwise in this order. As shown in FIG. 6, bars B11, B12, B13, B14, B15 and B16, connecting the link connection points L11 to L16, are disposed clockwise in this order. The link mechanism for displacement amplification comprises the following four groups: group 1 consisting of the link connection points L11, L12 and the bar B11 connecting these points; group 2 consisting of the link connection points L12, L13 and the bar B12 connecting these points; group 3 consisting of the link connection points L14, L15 and the bar B14 connecting these points; and group 4 consisting of the link connection points L15, L16 and the bar B15 connecting these points.

The link mechanism for displacement amplification is thus constructed in an annular shape. The operation of the link mechanism for displacement amplification will now be described taking the group 1 as an example. It is noted that the groups 1 and 2 are disposed vertically symmetrically, the groups 1 and 4 are disposed horizontally symmetrically, and the groups 2 and 3 are disposed horizontally symmetrically.

Accordingly, the operation of the group 1 is identical to the operation of each of the other three groups, and therefore a description of the other groups is omitted.

The link mechanism for displacement amplification operates to amplify a small displacement to produce a large displacement by using the principle of leverage. In particular, the link mechanism has a point of effort, a fulcrum and a point of load, which are essential for leverage. In FIG. 6, the link connection point L11 belonging to the group 1 acts as a point E1 of effort: Due to the displacement C1 produced in the support Iron core 3*a* by the supply of electric current to the wiring 6, a displacement G11 toward the gap 5 is produced in the link connection point L11 in the direction of the arrow of FIG. 6. The point F1 of intersection between a line Le11, extending from the link connection point L11 in a horizontal direction in which the movable iron core 4*b* is convex curved, and a line Le12 extending from the link connection point L12 vertically toward the support iron core 3*a*, serves as a fulcrum. The link connection point L12 serves as a point L1 of load where a displacement G12 is produced, in a direction in which the movable iron core 4*b* is convex curved, by leverage amplification of the displacement G11 which is produced at the link connection point L11 as the point E1 of effort.

The midpoint of the movable iron core 4*b* is displaced by a distance D1 in a direction in which the movable iron core 4*b* is convex curved. The displacement is illustrated by the broken lines and the symbol D1 in FIG. 6 in the portion of the movable iron core 4*b*.

The displacement amplification ratio is defined by the ratio of the distance D1 to the distance C1, and can be determined in the following manner: A line S1 is drawn vertically downward from the point E1 of effort. The angle formed between the line S1 and the bar B11, i.e. the line connecting the point E1 of effort and the point L1 of load, is represented by θ1, and the length of the bar B11 is represented by l1. The displacement amplification ratio A1 is equal to the ratio of the distance between the fulcrum F1 and the point L1 of load to the distance between the fulcrum F1 and the point E1 of effort, and can therefore be determined by the following equation:

$$A1=l1\cos\theta1/l1\sin\theta1=\cot\theta1 \quad (12)$$

Because of the above-described positional relationship between the groups 1 to 4, the same holds true for the groups 2 to 4. The link connection point L12, i.e. the point L1 of load, is common to the groups 1 and 2. Thus, the displacement produced at the link connection point L12 is Identical to the displacement D1 which is produced by the displacement amplification mechanisms of both of the groups 1 and 2.

The same holds true for the link connection point L15 of the movable iron core 4*a*.

As described hereinabove, according to this embodiment, a change caused in the length of the gap 5 between the two opposing surfaces 2*as*, 2*bs* of the attracting iron cores 2*a*, 2*b* can be amplified by the support iron cores 3*a*, 3*b* and the movable iron cores 4*a*, 4*b* and a large displacement can be produced at the point of displacement (point of load) L1.

The amplification of displacement makes it possible to secure a sufficient thrust force at least at a certain level over a wide displacement range which is intended to be used. Further, a sufficiently high thrust force can be obtained at a lower electric current even when the displacement is large. This can eliminate the necessity of using an electronic part(s), which is adapted for high electric current, in a current supply circuit, making it possible to avoid an increase in the cost or size of the circuit. When the magnetic flux in the magnetic circuits is decreased, the attracting iron cores 2*a*, 2*b* are returned to the original positions by the elastic forces of the support iron cores 3*a*, 3*b* and the movable iron cores 4*a*, 4*b*, constituting the displacement amplification mechanism 1A. Therefore, there is no need to separately provide an elastic body in order to return the attracting iron cores 2*a*, 2*b* to the original positions, making it possible to reduce the size and the cost of the displacement amplification mechanism 1A. In addition, the displacement amplification mechanism 1A, because of its integrated overall structure, can be easily produced e.g. in a single process step by using a mold.

Second Embodiment

A second embodiment of the present invention will now be described with reference to FIGS. 8 through 16.

Figure 8:
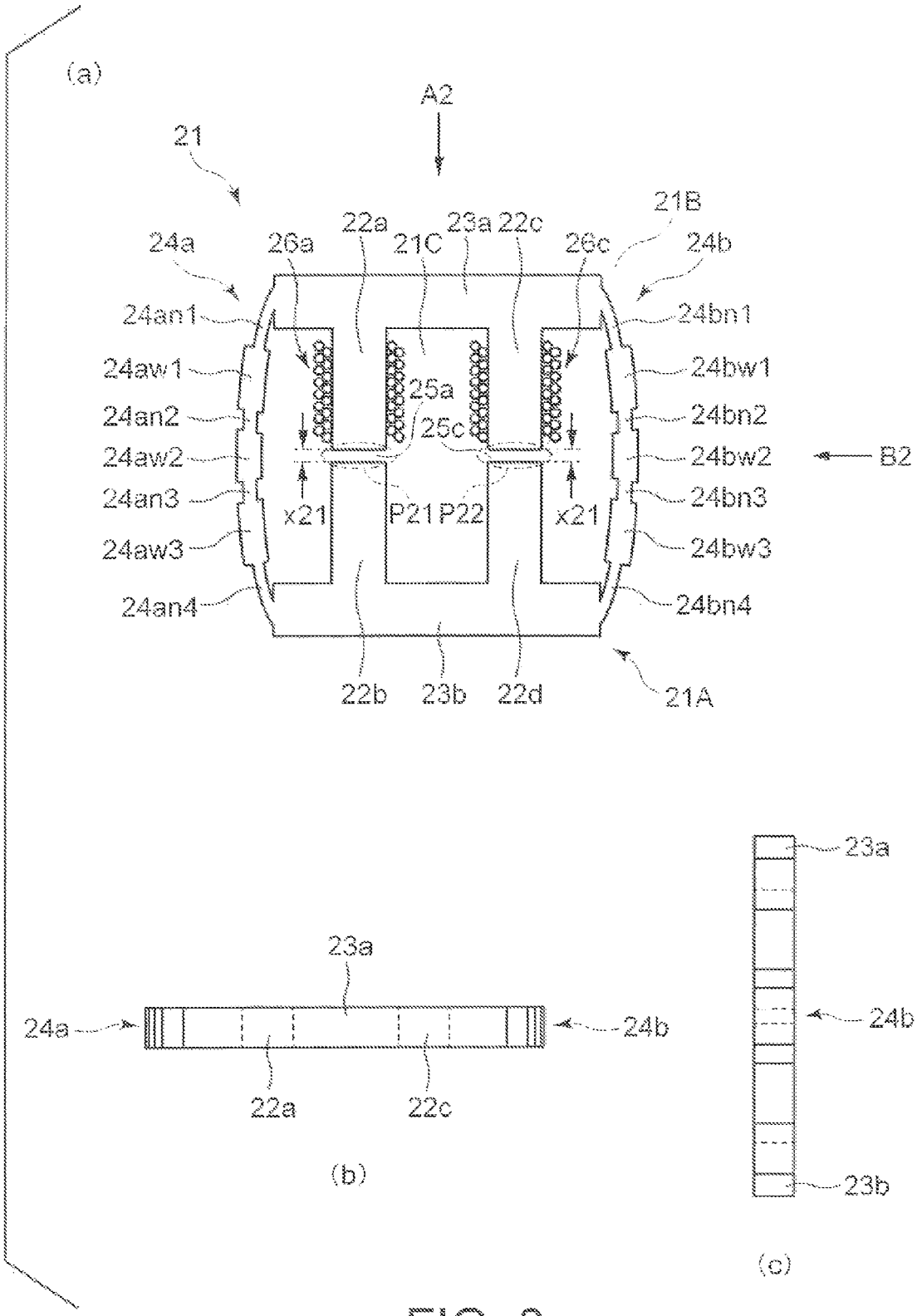
FIGS. 8(*a*) through 8(*c*) are diagrams showing an electromagnetic actuator according to a second embodiment of the present invention.
Figure 9:
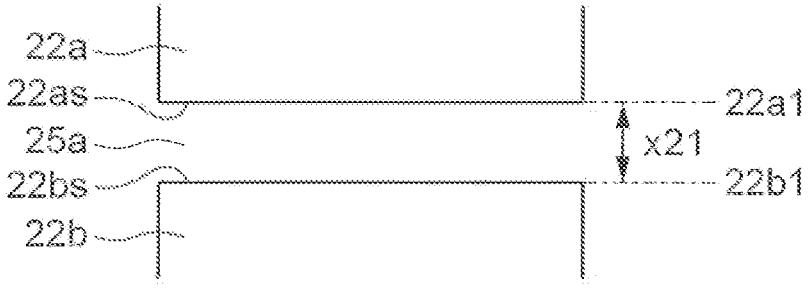
FIG. 9 is an enlarged view of the area P21 of FIG. 8(*a*)
Figure 10:
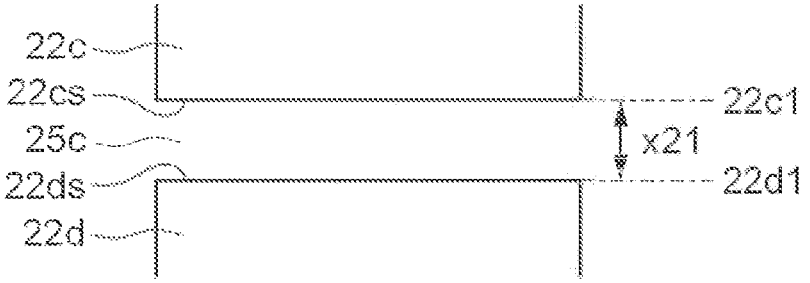
FIG. 10 is an enlarged view of the area P22 of FIG. 8(*a*)

FIG. 8(*a*) is a front view of an electromagnetic actuator, FIG. 8(*b*) shows the electromagnetic actuator of FIG. 8(*a*) as viewed in the direction of arrow A2, and FIG. 8(*c*) shows the electromagnetic actuator of FIG. 8(*a*) as viewed in the direction of arrow B2. FIG. 9 is an enlarged view of the area P21 of FIG. 8(*a*) and FIG. 10 is an enlarged view of the area P22 of FIG. 8(*a*).

As shown in FIGS. 8(*a*) through 8(*c*) and FIG. 9, the electromagnetic actuator 21 has a point L2 of displacement (point of load) as will be described later. The electromagnetic actuator 21 includes a displacement amplification mechanism 21A made of a magnetic material, having a quadrangular cross-section, having two opposing surfaces 22*as*, 22*bs* which form a gap 25*a* between them and having two opposing surfaces 22*cs*, 22*ds* which form a gap 25*c* between them, and coils (wirings) 26*a*, 26*c* provided in the displacement amplification mechanism 21A and which generate a magnetic flux in the displacement amplification mechanism 21A. By passing an electric current through the coils 26*a*, 26*c*, a magnetic flux is generated in the displacement amplification mechanism 21A to cause a change in the lengths x21, x22 of the gaps 25*a*, 25*c* between the surfaces 22*as*, 22*bs* and between the surfaces 22*cs*, 22*ds*, respectively, thereby displacing the point of displacement.

The displacement amplification mechanism 21A will now be described. The displacement amplification mechanism 21A includes a pair of support iron cores 23*a*, 23*b* comprised of elastic members, a pair of movable iron cores 24*a*, 24*b* comprised of elastic members and located on both sides of the pair of support iron cores 23*a*, 23*b*, a pair of attracting iron cores 22*a*, 22*b* extending inwardly from the support iron cores 23*a*, 23*b* and having the two opposing surfaces 22*as*, 22*bs* which form the gap 25*a*, and a pair of attracting iron cores 22*c*, 22*d* extending inwardly from the support iron cores 23*a*, 23*b* and having the two opposing surfaces 22*cs*, 22*ds* which form the gap 25*c*.

The support iron cores 23*a*, 23*b* and the movable iron cores 24*a*, 24*b* constitute an annular portion 21B, and the pair of attracting iron cores 22*a*, 22*b* and the pair of attracting iron cores 22*c*, 22*d* constitute a displacement portion 21C.

The constituent members of the displacement amplification mechanism 21A will now be described in further detail. An intermediate portion of the support iron core 23*a* is connected to one end of the attracting iron core 22*a* and another intermediate portion of the support iron core 23*a* is connected to one end of the attracting iron core 22*c*; the support iron core 23*a* and the attracting iron cores 22*a*, 22*c* form a π-shaped portion. Similarly, an intermediate portion of the support iron core 23*b*, having the same shape as the support iron core 23*a*, is connected to one end of the attracting iron core 22*b* having the same shape as the attracting iron core 22*a* and another intermediate portion of the support iron core 23*b* is connected to one end of the attracting iron core 22*d* having the same shape as the attracting iron core 22*c*; the support iron core 23*a* and the attracting iron cores 22*a*, 22*c* form a π-shaped portion. The surfaces of the other ends of the attracting iron cores 22*a*, 22*c* face the surfaces of the other ends of the attracting iron cores 22*b*, 22*d*. The movable iron cores 24*a*, 24*b* are connected to the opposite ends of the support iron cores 23*a* and 23*b*.

The movable iron cores 24*a*, 24*b* are slightly convex curved outward, i.e. in a direction away from the attracting iron cores 22*a*, 22*b* and the attracting iron cores 22*c*, 22*d*.

The movable iron cores 24*a*, 24*b* each consist of portions which are formed thick and portions which are formed thin in a direction in which they are convex curved, the thick portions and the thin portions being arranged alternately. In particular, the movable iron core 24*a* consists of: a movable iron core thin portion 24*an*1 coupled to the support iron core 23*a*, a movable iron core thick portion 24*aw*1, a movable iron core thin portion 24*an*2; a movable iron core thick portion 24*aw*2, a movable iron core thin portion 24*an*3, a movable iron core thick portion 24*aw*3, and a movable iron core thin portion 24*an*4 coupled to the support iron core 23*b*, the portions being arranged in this order.

Similarly, the movable iron core 24*b* consists of: a movable iron core thin portion 24*bn*1 coupled to the support iron core 23*a*, a movable iron core thick portion 24*bw*1, a movable iron core thin portion 24*bn*2; a movable iron core thick portion 24*bw*2, a movable iron core thin portion 24*bn*3, a movable iron core thick portion 24*bw*3, and a movable iron core thin portion 24*bn*4 coupled to the support iron core 23*b*, the portions being arranged in this order.

As described above, the support iron cores 23*a*, 23*b* and the movable iron cores 24*a*, 24*b* constitute the annular portion 218. Further, as described above, the opposing surfaces 22*as*, 22*bs* of the attracting iron cores 22*a*, 22*b* form the slight gap 25*a* with the length x21, and the opposing surfaces 22*cs*, 22*ds* of the attracting iron cores 22*c*, 22*d* form the slight gap 25*c* with the length x21. The wirings 26*a*, 26*c*, composed of a linear conductive material such as a copper wire, are wound around the attracting iron cores 22*a*, 22*c*, respectively.

The wirings 26*a*, 26*c* are omitted in FIGS. 8(*b*) and 8(*c*). As shown in FIGS. 8(*b*) and 8(*c*), the cross-sectional area of each of the attracting iron cores 22*a*, 22*b*, 22*c*, 22*d* is approximately the same as the cross-sectional area of each of the support iron cores 23*a*, 23*b*. As shown in FIGS. 9 and 10 which are enlarged views of the areas P21, P22 of FIG. 8(*a*), respectively, the gap 25*a* is formed between the opposing surfaces 22*as*, 22*bs*, lying at positions 22*a*1, 22*b*1, of the attracting iron cores 22*a*, 22*b*, with the distance between the positions 22*a*1, 22*b*1 being x21. Similarly, the gap 25*c* is formed between the opposing surfaces 22*cs*, 22*ds*, lying at positions 22*c*1, 22*d*1, of the attracting iron cores 22*c*, 22*d*, with the distance between the positions 22*c*1, 22*d*1 being x21.

The operation of the electromagnetic actuator of this embodiment, having the above-described construction, will now be described with reference to FIGS. 11 through 13.

Figure 11:
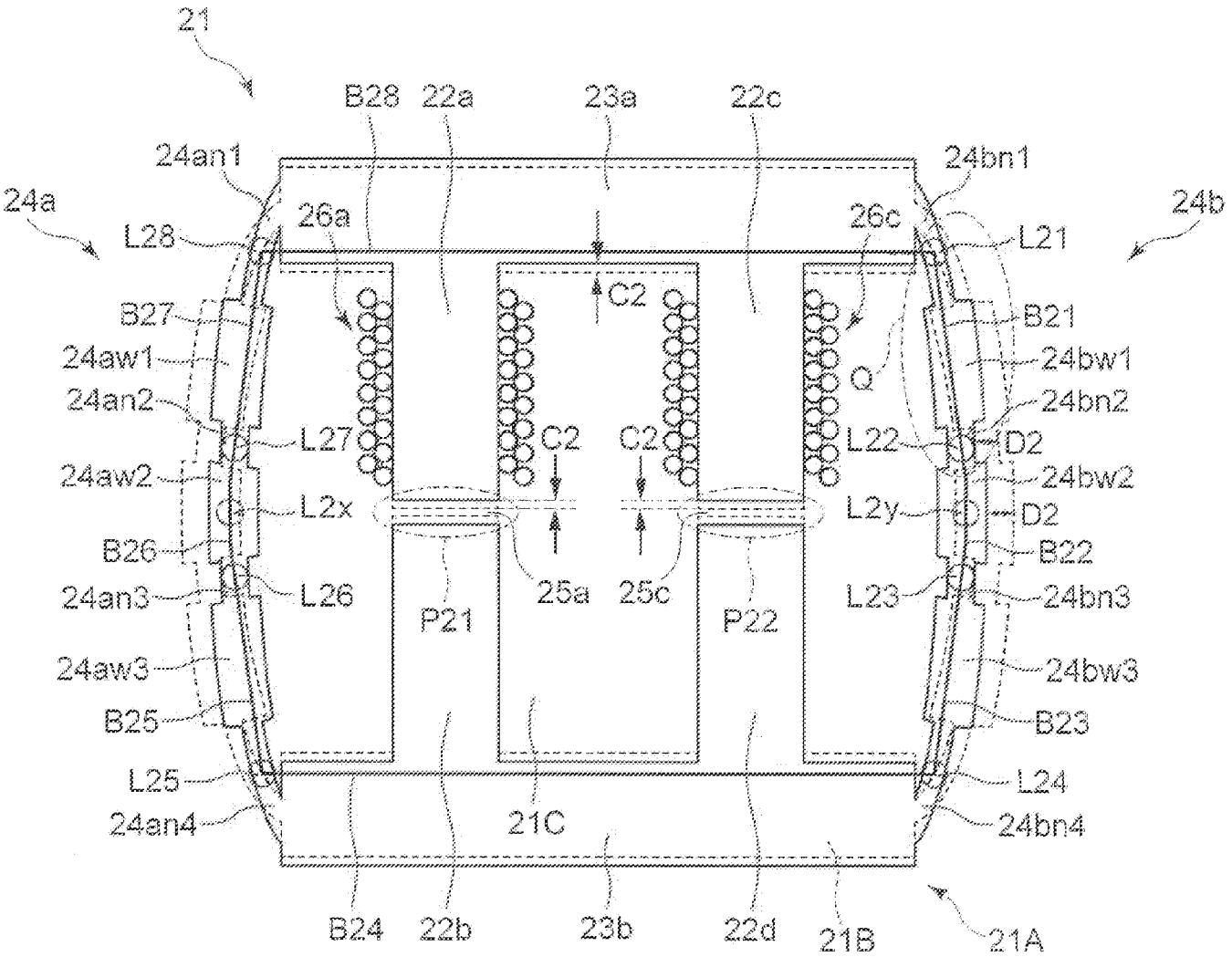
FIG. 11 is an enlarged view of the electromagnetic actuator of FIG. 8(*a*)

FIG. 11 is an enlarged view of the electromagnetic actuator of FIG. 8(*a*). When a voltage is applied to the coils (wirings) 26*a*, 26*c* by connecting a not-shown power source to both ends of the coils (wirings) 26*a*, 26*c*, an electric current is supplied to the wirings 26*a*, 26*c*. Upon the supply of electric current, a magnetic circuit is formed through which a magnetic flux passes as follows: attracting iron core 22*a*→support iron core 23*a*→attracting iron core 22*c*→gap 25*c*→attracting iron core 22*d*→support iron core 23*b*→attracting iron core 22*b*→gap 25*a*→attracting iron core 22*a*. The magnetic flux in the magnetic circuit increases by the supply of electric current. The displacement amplification mechanism 21A thus forms the magnetic circuit including the support iron cores 23*a*, 23*b* and the movable iron cores 24*a*, 24*b* and through which a magnetic flux passes. The magnetic circuit includes the gap (thrust portion) 25*a* formed between the surfaces 22*as*, 22*bs* of the attracting iron cores 22*a*, 22*b* of magnetic material, and the gap (thrust portion) 25*c* formed between the surfaces 22*cs*, 22*ds* of the attracting iron cores 22*c*, 22*d* of magnetic material, as shown in FIGS. 9 and 10. Therefore, an attraction force (thrust force) is generated between the surfaces 22*as*, 22*bs* through the gap 25*a*, and an attraction force is generated between the surfaces 22*cs*, 22*ds* through the gap 25*c*. Because the support iron cores 23*a*, 23*b* and the movable iron cores 24*a*, 24*b* are comprised of elastic members, the attraction force generated between the opposing surfaces 22*as*, 22*bs* of the attracting iron cores 22*a*, 22*b* causes the surfaces 22*as*, 22*bs* to move closer to each other, and the attraction force generated between the opposing surfaces 22*cs*, 22*ds* of the attracting iron cores 22*c*, 22*d* causes the surfaces 22*cs*, 22*ds* to move closer to each other.

Figure 12:
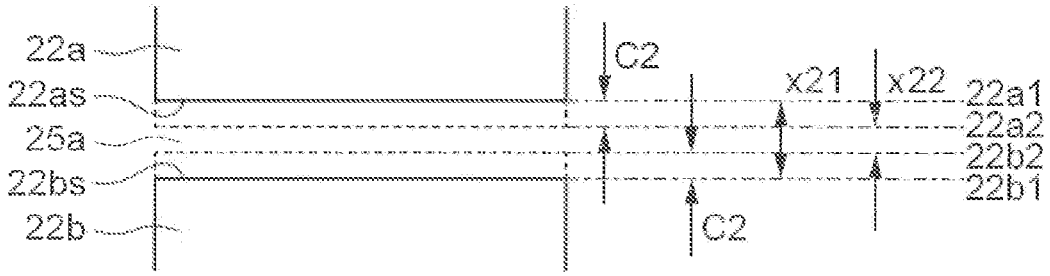
FIG. 12 is an enlarged view of the area P21 of FIG. 11.
Figure 13:
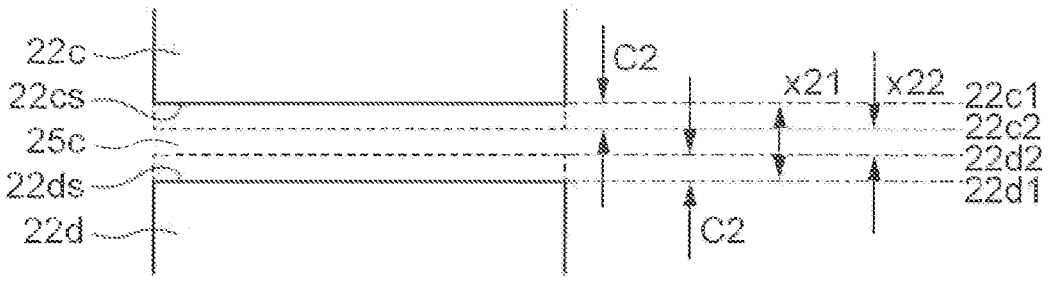
FIG. 13 is an enlarged view of the area P22 of FIG. 11.

The movement is illustrated in FIGS. 12 and 13 which are enlarged views of the area P21 and the area P22, respectively, of FIG. 11. When no electric current is flowing in the wirings 26*a*, 26*c* in FIG. 11, the positions of the opposing surfaces 22*as*, 22*bs* of the attracting iron cores 22*a*, 22*b* are 22*a*1 and 22*b*1, respectively, in FIG. 12 and the distance between them is x21 as in FIG. 9. This is illustrated by the solid lines in FIG. 12.

As described above, when an electric current flows in the wirings 26*a*, 26*c* in FIG. 11, an attraction force acts between the opposing surfaces 22*as*, 22*bs* of the attracting iron cores 22*a*, 22*b*, whereby the position of the surface 22*as* and the position of the surface 22*bs* come closer to 22*a*2 and 22*b*2, respectively, and the gap 25*a* becomes narrower; the distance between the surfaces 22*as*, 22*bs* becomes x22 as shown by the broken lines in FIG. 12. Thus, by supplying the electric current to the wirings 26*a*, 26*c*, a displacement C2 is produced in each of the surfaces 22*as*, 22*bs* as shown in FIG. 12.

When the application of voltage to the wirings 26*a*, 26*c* is shut off, the electric current disappears and the magnetic flux in the above-described magnetic circuit decreases, whereby the attraction force, acting between the surfaces 22*as*, 22*bs*, disappears. Because the support iron cores 23*a*, 23*b* and the movable iron cores 24*a*, 24*b* are comprised of elastic members, the opposing surfaces 22*as*, 22*bs* of the attracting iron cores 22*a*, 22*b* return to the positions 22*a*1, 22*b*1, respectively.

Thus, the gap 25*a* returns to the state as observed when there is no electric current flowing in the wirings 26*a*, 26*c*, i.e. when there is no generation of magnetic flux; the distance between the surfaces 22*as*, 22*bs* becomes x21.

As described above, a displacement C2 is produced in each of the opposing surfaces 22*as*, 22*bs* of the attracting iron cores 22*a*, 22*b* in the electromagnetic actuator 21. The same displacement C2 is produced by the same mechanism in the gap 25*c* between the attracting iron cores 22*c*, 22*d*, shown in FIG. 13. The displacement C2 produced in each of the opposing surfaces 22*as*, 22*bs* of the attracting iron cores 22*a*, 22*b*, and the displacement C2 produced in each of the opposing surfaces 22*cs*, 22*ds* of the attracting iron cores 22*c*, 22*d* are Illustrated also in the areas P21, P22 of FIG. 11.

In this embodiment the attracting iron cores 22*a*, 22*b*, 22*c*, 22*d* thus return to the original positions by the elastic forces of the support iron cores 23*a*, 23*b* and the movable iron cores 24*a*, 24*b*, constituting the displacement amplification mechanism 21A. Therefore, there is no need to separately provide an elastic body in order to return the attracting iron cores 22*a*,

22*b*, 22*c*, 22*d* to the original positions, making it possible to reduce the size and the cost of the displacement amplification mechanism 21A.

The mechanism of amplification of the displacement C2 will now be described with reference to FIG. 11.

The displacement C2 in each of the opposing surfaces 22*as*, 22*bs* of the attracting iron cores 22*a*, 22*b* in the area P21, shown by the broken lines in FIG. 11, is produced at the opposing ends of the attracting iron cores 22*a*, 22*b*. Therefore, the same displacement C2 in the same direction is produced also in the support iron cores 23*a*, 23*b* whose intermediate portions are connected to the other ends of the attracting iron cores 22*a*, 22*b*. This is illustrated in FIG. 11 in the portion of the support iron core 23*a* by the broken lines and the symbol C2, indicating the same displacement as in the attracting iron core 22*a*. The displacement C2 of the support iron core 23*a* is amplified by the support iron core 23*a* and by the movable iron cores 24*a*, 24*b* connected to both ends of the support iron core 23*a*. The support iron core 23*a* and the support iron core 23*b* are disposed vertically symmetrically. Thus, the support iron cores 23*a*, 23*b* and the movable iron cores 24*a*, 24*b* as a whole constitute a link mechanism for displacement amplification.

The principle will now be described with reference to a link mechanism as applied to the support iron cores 23*a*, 23*b* and the movable iron cores 24*a*, 24*b*, constituting the displacement amplification mechanism 21A. The link mechanism has eight link connection points: a connection point L21 between the support iron core 23*a* and the movable iron core thin portion 24*bn*1; a midpoint L22 of the movable iron core thin portion 24*bn*2; a midpoint L23 of the movable iron core thin portion 24*bn*3; a connection point L24 between the movable iron core thin portion 24*bn*4 and the support iron core 23*b*; a connection point L25 between the support iron core 23*b* and the movable iron core thin portion 24*an*4; a midpoint L26 of the movable iron core thin portion 24*an*3; a midpoint L27 of the movable iron core thin portion 24*an*2; and a connection point L28 between the movable iron core thin portion 24*an*1 and the support iron core 23*a*. The link connection points L21, L22, L23, L24, L25, L26, L27, L28 are disposed clockwise in this order. As shown in FIG. 11, bars B21, B22, B23, B24, B25, B26, B27, B28, connecting the link connection points L21 to L28, are disposed clockwise in this order.

The link mechanism for displacement amplification comprises the following four groups: group 1 consisting of the link connection points L21, L22 and the bar B21 connecting these points; group 2 consisting of the link connection points L23, L24 and the bar B23 connecting these points; group 3 consisting of the link connection points L25, L26 and the bar B25 connecting these points; and group 4 consisting of the link connection points L27, L28 and the bar B27 connecting these points.

Figure 14:
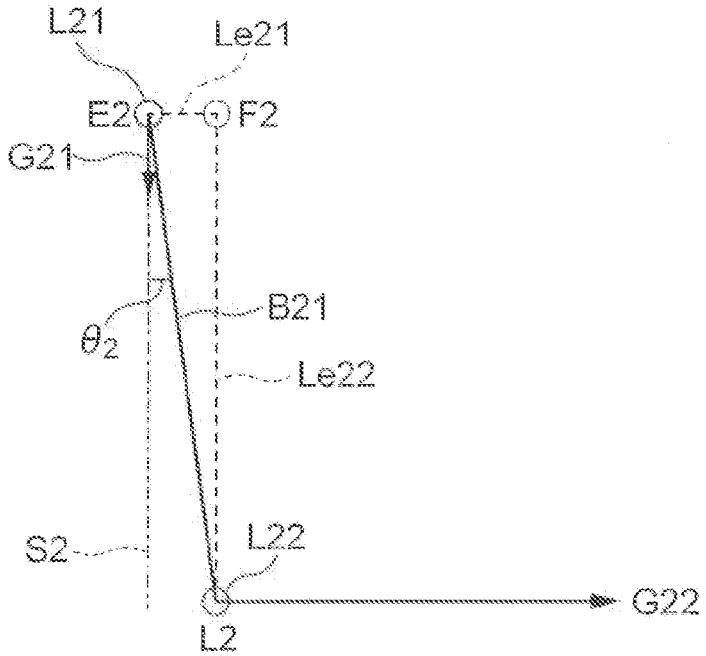
FIG. 14 is an enlarged view of the area Q of FIG. 11.

The link mechanism for displacement amplification is thus constructed in an annular shape. The operation of the link mechanism for displacement amplification will now be described with reference to FIGS. 11 and 14, taking the group 1 as an example. FIG. 14 is an enlarged view of the group 1, i.e. the area Q of FIG. 11. It is noted that the groups 1 and 2 are disposed vertically symmetrically, the groups 1 and 4 are disposed horizontally symmetrically, and the groups 2 and 3 are disposed horizontally symmetrically. Accordingly, the operation of the group 1 is identical to the operation of each of the other three groups, and therefore a description of the other groups is omitted.

In FIG. 11, the link connection point L21 belonging to the group 1 acts as a point E2 of effort (FIG. 14): Due to the displacement C2 produced in the support iron core 23*a* by the application of voltage to the wirings 26*a*, 26*b*, a displacement G21 toward the gap 25*c* is produced in the link connection point L21 in the direction of the arrow of FIG. 14. The point F2 (FIG. 14) of intersection between a line Le21 (FIG. 14), extending from the link connection point L21 in a horizontal direction in which the movable iron core 24*b* is convex curved, and a line Le22 (FIG. 14) extending from the link connection point L22 vertically toward the support iron core 23*a*, serves as a fulcrum. The link connection point L22 serves as a point L2 of load (FIG. 14) where a displacement G22 is produced, in a direction in which the movable iron core 24*b* is convex curved, by leverage amplification of the displacement G21 which is produced at the link connection point L21 as the point E2 of effort.

The link connection point L22 is displaced by a distance D2 (FIG. 11) in a direction in which the movable iron core 24*b* is convex curved.

The displacement amplification ratio is defined by the ratio of the distance D2 to the distance C2 in FIG. 11, and can be determined in the following manner: A line S2 is drawn vertically downward from the point E2 of effort. The angle formed between the line S2 and the bar B21, i.e. the line connecting the point E2 of effort and the point L2 of load, is represented by θ2, and the length of the bar B21 is represented by l2. The displacement amplification ratio A2 is equal to the ratio of the distance between the fulcrum F2 and the point L2 of load to the distance between the fulcrum F2 and the point E2 of effort, and can therefore be determined by the following equation:

$$A2=l2\cos\theta2/l2\sin\theta2=\cot\theta2 \quad (13)$$

Because of the above-described positional relationship between the groups 1 to 4, the same holds true for the groups 2 to 4.

Consider now an operating point L2y which is a midpoint between the link connection point L22 as the point of load in the group 1 and the link connection point L23 as the point of load in the group 2. The operating point L2y is the midpoint of the movable iron core 24*b*, and therefore the same displacement D2 as in the link connection points L22 and L23 is produced in the operating point L2y. The same holds true for an operating point L2x which is a midpoint between the link connection point L26 of the group 3 and the link connection point L27 of the group 4, and which is the midpoint of the movable iron core 24*a*.

As shown in FIG. 8(*a*), the movable iron cores 24*a*, 24*b* each consist of portions which are formed thick and portions which are formed thin in a direction in which they are curved, i.e. in a direction in which displacement occurs, the thick portions and the thin portions being arranged alternately. Compared to the movable iron cores 4*a*, 4*b* of the electromagnetic actuator 1 of the first embodiment, shown in FIG. 1, the movable iron cores 24*a*, 24*b* can move easily by the amplified displacement because of the presence of the thin portions.

On the other hand, because of the presence of a considerable proportion of the thin portions, having a relatively small cross-sectional area, in the movable iron cores 24*a*, 24*b*, a magnetic circuit including the movable iron cores 24*a*, 24*b* may have an increased reluctance.

It may therefore be difficult only with the magnetic circuit including the movable iron cores 24*a*, 24*b* to generate such a high magnetic flux as to be capable of generating a sufficiently high attraction force between the opposing surfaces 22*as*, 22*bs* on both sides of the gap 25*a*, shown in FIG. 9, and between the opposing surfaces 22*cs*, 22*ds* on both sides of the gap 25*c*, shown in FIG. 10. It is, however, possible to secure an amount of magnetic flux that can generate a sufficiently high attraction force between the opposing surfaces by constructing a magnetic circuit including the attracting iron cores 22*a*, 22*b*, 22*c*, 22*d* having a large cross-sectional area. Thus, the support iron cores 23*a*, 23*b*, which are part of the members (the support iron cores 23*a*, 23*b* and the movable iron cores 24*a*, 24*b*) constituting the displacement amplification mechanism 21A, are used to constitute the principal magnetic circuit.

Figure 15:
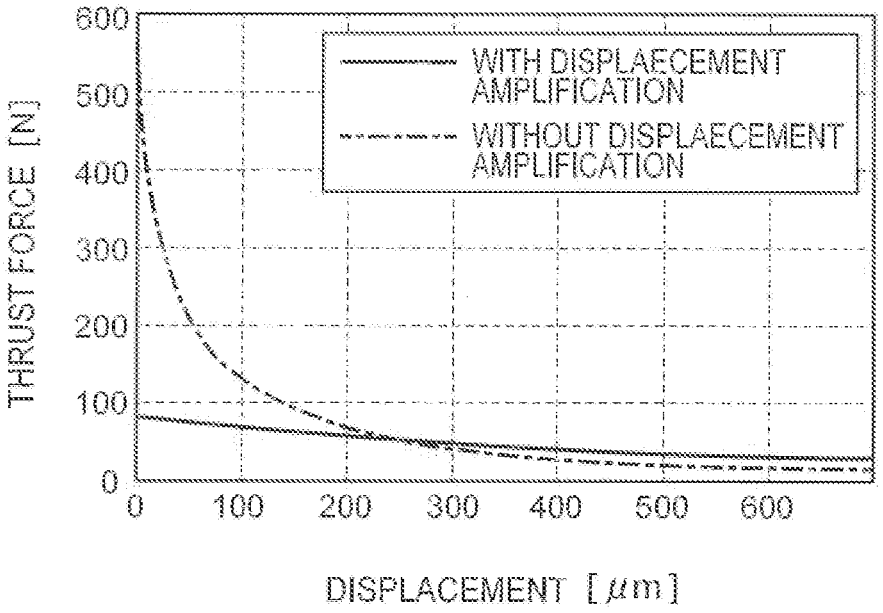
FIG. 15 is a graph showing the relationship between displacement and thrust force in the electromagnetic actuator of the second embodiment.

FIG. 15 is a graph showing an exemplary relationship between displacement and thrust force in the electromagnetic actuator of the second embodiment. The dashed-dotted line shows a relationship as observed when no displacement amplification is made, while the solid line shows a relationship as observed when the displacement amplification is made, the relationships being determined under constant electric current conditions. As can be seen in FIG. 15, the thrust force with the displacement amplification is larger than the thrust force without the displacement amplification when the displacement is larger than 250 μm, which is the displacement value at the intersection of the dashed-clotted line and the solid line. Conversely, the thrust force with the displacement amplification is smaller than the thrust force without the displacement amplification when the displacement is smaller than 250 μm.

The data in FIG. 15 also demonstrates that by making the displacement amplification, the range of change in the thrust force is reduced over a wide range of distribution. It therefore becomes possible to secure a sufficient thrust force at least at a certain level over a wide displacement range which is intended to be used.

Figure 16:
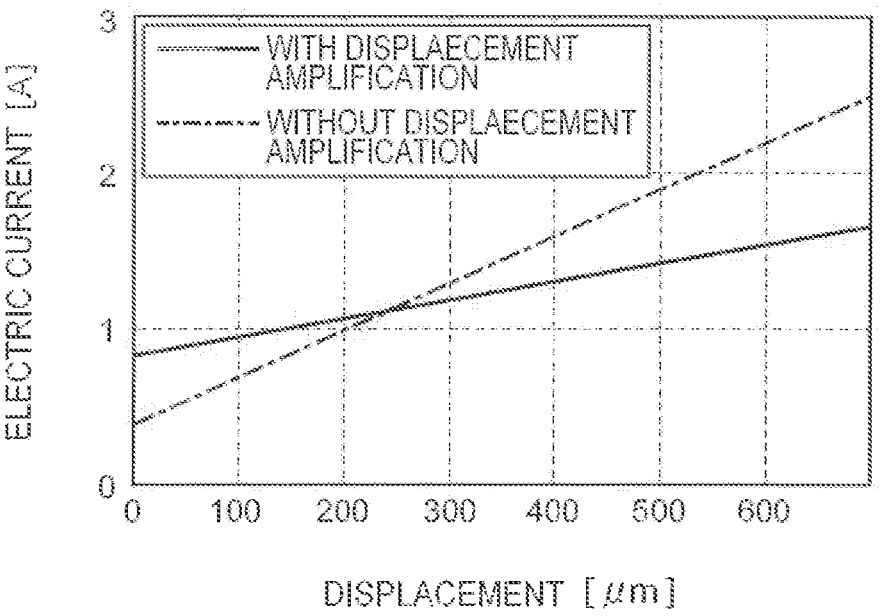
FIG. 16 is a graph showing the relationship between displacement and electric current in the electromagnetic actuator of the second embodiment.

FIG. 16 is a graph showing an exemplary relationship between displacement and electric current in the electromagnetic actuator of the second embodiment. The dashed-dotted line shows a relationship as observed when no displacement amplification is made, while the solid line shows a relationship as observed when the displacement amplification is made, the relationships being determined under constant thrust force conditions. As can be seen in FIG. 16, the electric current with the displacement amplification is lower than the electric current without the displacement amplification when the displacement is larger than 250 μm, which is the displacement value at the intersection of the dashed-dotted line and the solid line. Conversely, the electric current with the displacement amplification is higher than the electric current without the displacement amplification when the displacement is smaller than 250 μm. As described above, this means that when it is intended to obtain a sufficient thrust force in a displacement range which is higher than a certain displacement, it is not necessary to use an electronic part(s), which is adapted for high electric current, in a current supply circuit, making it possible to avoid an increase in the cost or size of the circuit.

Figure 17:
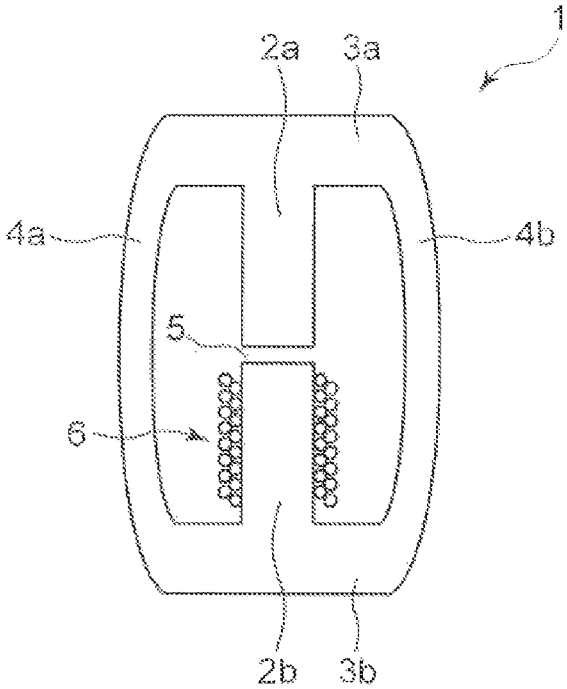
FIG. 17 is a diagram showing a variation in the first embodiment.

Variations can be made to the above-described embodiments:

Though in the first embodiment the wiring 6 is wound around the attracting iron core 2*a* as shown in FIG. 4(*a*), the wiring 6 may be wound around the attracting iron core 2*b* instead, as shown in FIG. 17.

Figure 18:
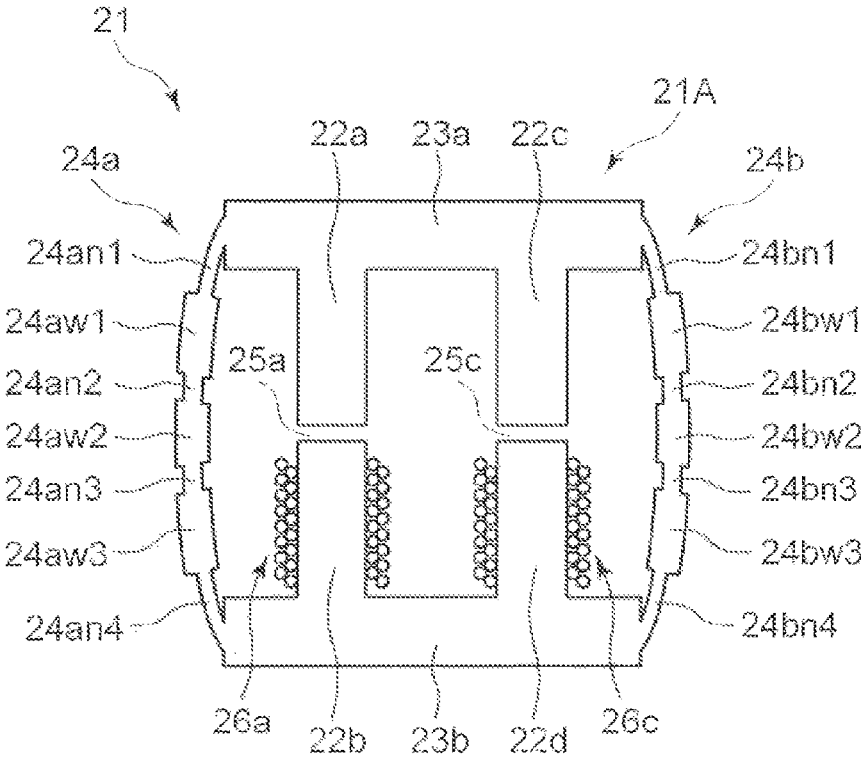
FIG. 18 is a diagram showing a first variation in the second embodiment.
Figure 19:
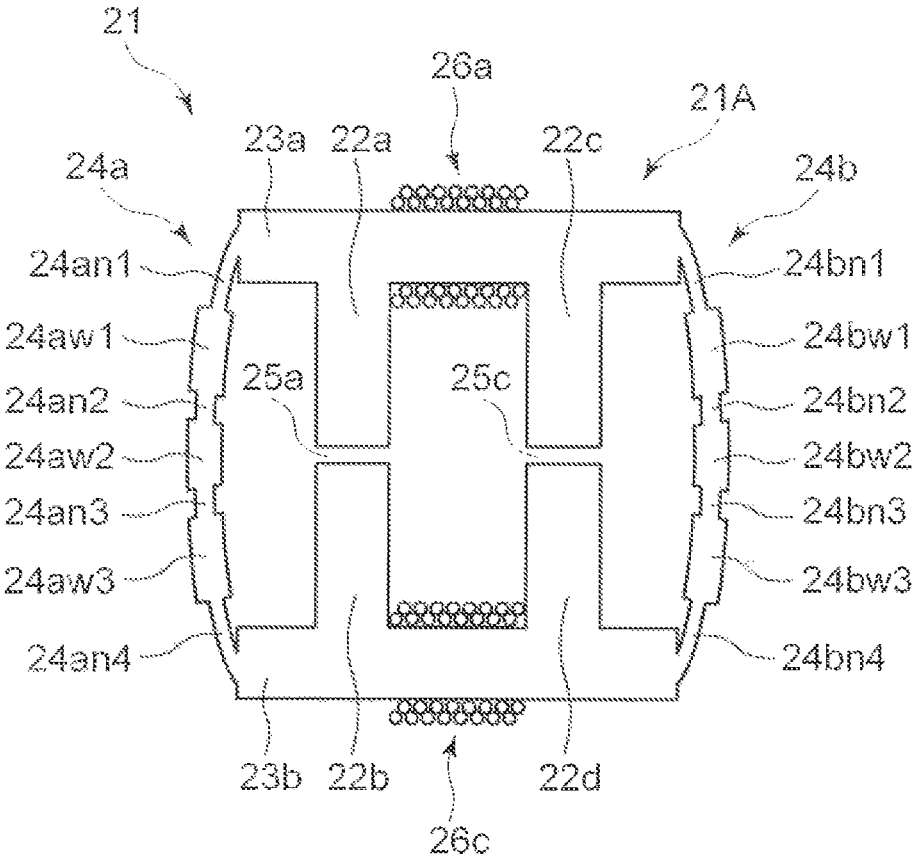
FIG. 19 is a diagram showing a second variation in the second embodiment.
Figure 20:
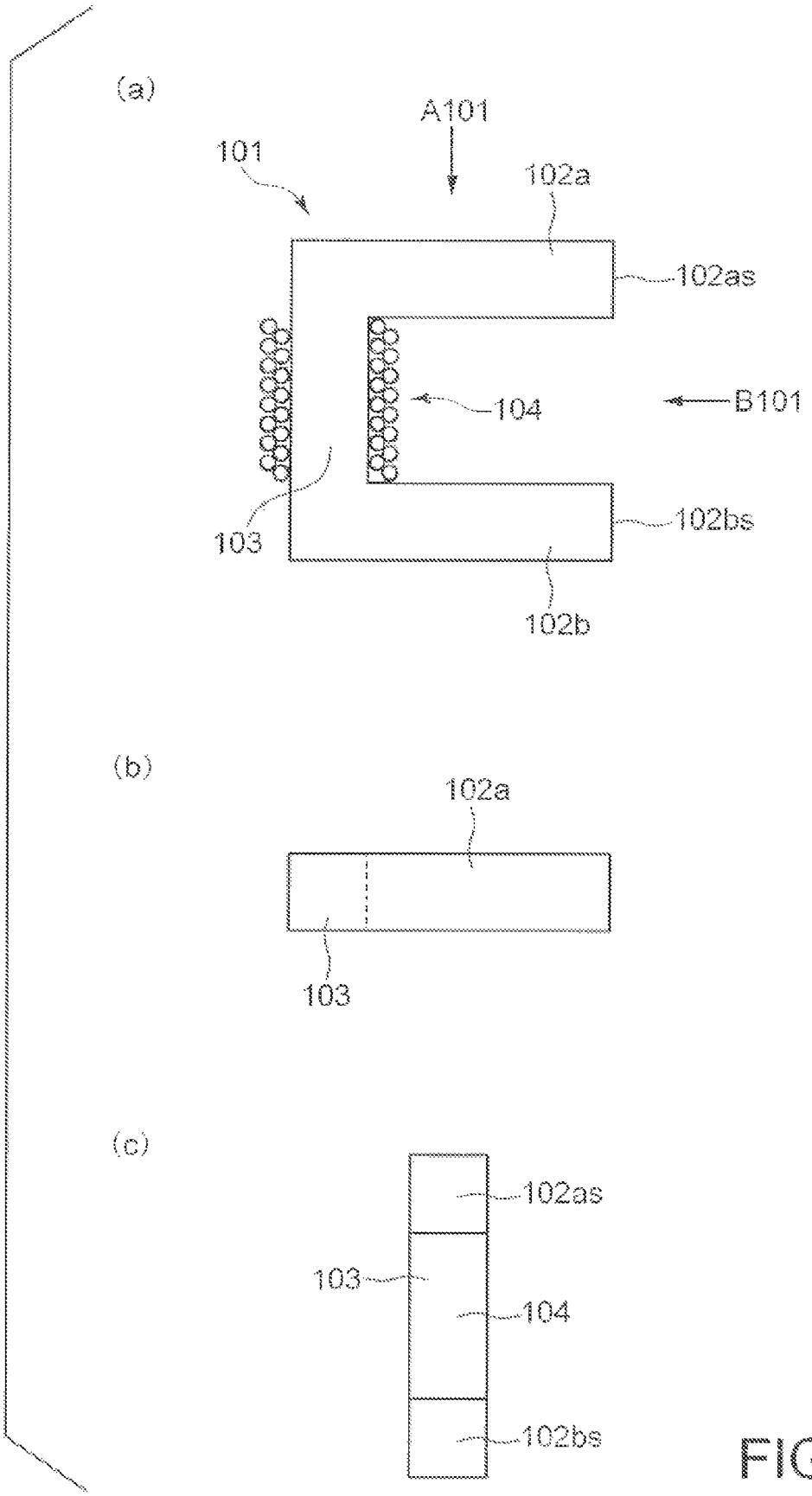
FIGS. 20(*a*) through 20(*c*) are diagrams showing a prior-art electromagnetic attraction force generation mechanism.
Figure 21:
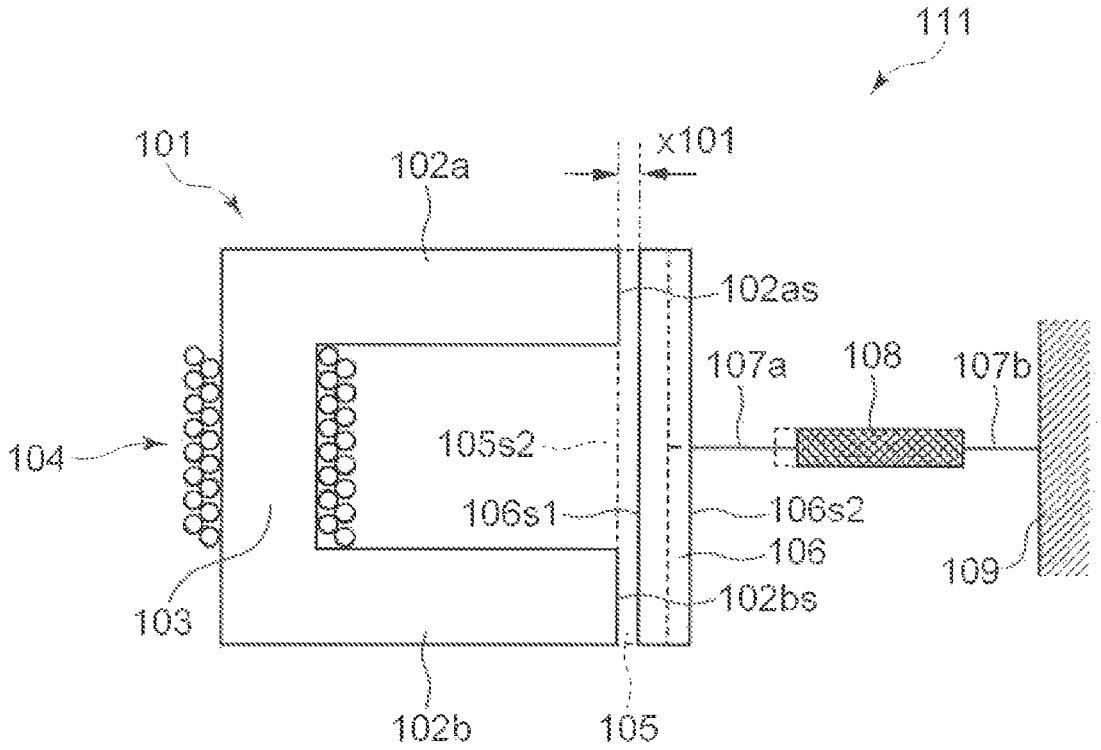
FIG. 21 is a diagram showing a prior-art electromagnetic actuator.

Though in the second embodiment the wirings 26*a*, 26*c* are wound around the attracting iron cores 22*a*, 22*c* as shown in FIG. 8(*a*), the wirings 26*a*, 26*c* may be wound around the attracting iron core 22*b*, 22*d* instead, as shown in FIG. 18. Alternatively, as shown in FIG. 19, the wirings 26*a*, 26*c* may be wound around a portion of the support iron core 23*a*, lying between the attracting iron cores 22*a*, 22*c*, and a portion of the support iron core 23*b*, lying between the attracting iron cores 22*b*, 22*d*, respectively.

Though in the above-described embodiments the displacement amplification mechanisms 1A, 21A are formed in an annular shape, the displacement amplification mechanism 1A, 21A may not necessarily have an annular shape if at least part of them is comprised of a magnetic circuit through which a magnetic flux passes.

Though in the above-described embodiments the magnetic circuits have a gap between two opposing surfaces, a mechanism for generating a thrust force by the action of a magnetic circuit, constituting at least part of the displacement amplification mechanism 1A, 21A, is not limited to such a gap between two opposing surfaces of magnetic bodies, formed in the magnetic circuit.

DESCRIPTION OF THE REFERENCE NUMERALS

1A, 21A displacement amplification mechanism
2*a*, 2*b*, 22*a*, 22*b*, 22*c*, 22*d*, 102*a*, 102*b* attracting iron core
3*a*, 3*b*, 23*a*, 23*b* support iron core
4*a*, 4*b*, 24*a*, 24*b* movable iron core
24*an*1, 24*an*2, 24*an*3, 24*an*4 movable iron core thin portion
24*bn*1, 24*bn*2, 24*bn*3, 24*bn*4 movable iron core thin portion
24*aw*1, 24*aw*2, 24*aw*3 movable iron core thick portion
24*bw*1, 24*bw*2, 24*bw*3 movable iron core thick portion
5, 25*a*, 25*c*, 105 gap
6, 26*a*, 26*c*, 104 wiring
101 prior-art electromagnetic attraction force generation mechanism
103 magnetic force generating iron core
106 movable iron core
107*a*, 107*b* wire
108 spring
109 wall surface
111 prior-art electromagnetic actuator
M0 magnetic circuit
Mc magnetic body
G gap

What is claimed is:

1. An electromagnetic actuator having a point of amplified displacement, comprising:

a magnetic body comprising:

an annular portion including a pair of support iron cores and a pair of movable iron cores connected to the opposite ends of the support iron cores, the movable iron cores including the point of amplified displacement (L1), and at least one pair of displacement portions disposed inside the annular portion and forming a gap therebetween; and a coil, provided in the magnetic body, configured to generate a magnetic flux in the magnetic body, when an electric current is passed through the coil, wherein the length of the gap between the displacement portions is configured to change when the magnetic flux is generated, and the change in the length of the gap is amplified by the support iron cores and the movable iron cores to produce a large displacement at the point of amplified displacement by using the principle of leverage.

2. The electromagnetic actuator according to claim 1, wherein at least part of the annular portion is comprised of an elastic member.

3. The electromagnetic actuator according to claim 1, wherein the coil is provided in one of the pair of displacement portions.

* * * * *